US012358673B1

(12) United States Patent
Huang

(10) Patent No.: US 12,358,673 B1
(45) Date of Patent: Jul. 15, 2025

(54) CARTON SEALER ADOPTING WET TAPE

(71) Applicant: FUJIAN JIALONG ADHESIVE TAPE CO., LTD., Zhangzhou (CN)

(72) Inventor: Benyu Huang, Ningde (CN)

(73) Assignee: FUJIAN JIALONG ADHESIVE TAPE CO., LTD., Zhangzhou (CN)

( * ) Notice: Subject to any disclaimer, the term of this patent is extended or adjusted under 35 U.S.C. 154(b) by 0 days.

(21) Appl. No.: 18/412,593

(22) Filed: Jan. 14, 2024

(51) Int. Cl.
*B65B 51/06* (2006.01)
*B65B 7/20* (2006.01)
*B65B 43/52* (2006.01)

(52) U.S. Cl.
CPC ..... *B65B 51/067* (2013.01); *B65B 7/20* (2013.01); *B65B 43/52* (2013.01)

(58) Field of Classification Search
CPC ..... B65B 51/067; B65B 7/20; B65B 43/52
See application file for complete search history.

(56) References Cited

U.S. PATENT DOCUMENTS 1,434,230 A * 10/1922 Shawver ..... B65B 7/20 53/376.5
2,052,903 A * 9/1936 Stagmeler ..... B65B 51/067 156/DIG. 4
3,981,123 A * 9/1976 Flanagan ..... B65B 51/023 118/DIG. 3
4,008,682 A * 2/1977 Meyer ..... B65H 35/0046 118/225
4,044,527 A * 8/1977 Ulrich ..... B65B 51/067 53/76
4,061,526 A * 12/1977 Warshaw ..... B65B 51/067 156/530
4,161,138 A * 7/1979 Marchetti ..... B65B 59/005 53/136.4
4,572,760 A * 2/1986 Marchetti ..... B65B 59/003 156/468
4,633,642 A * 1/1987 Lissoni ..... B65B 51/067 53/136.4
4,658,563 A * 4/1987 Lissoni ..... B65B 51/067 53/136.4

(Continued)

FOREIGN PATENT DOCUMENTS

CN 105398615 A 3/2016
CN 105883079 A * 8/2016 ..... B65B 43/52

(Continued)

*Primary Examiner* — Anna K Kinsaul
*Assistant Examiner* — Mobeen Ahmed
(74) *Attorney, Agent, or Firm* — Nitin Kaushik

(57) ABSTRACT

A carton sealer adopting a wet tape is disclosed. After passing through a space between an upper conveying roller and a lower conveying roller, a tape pulled out of a tape roll mounted on an unwinding device sequentially passes through a tape through hole of a tape cutting device, passes by a wetting roller of a wetting device, and extends out of the downside of a lifting frame. During work, the tape is cut off by the tape cutting device, and the cut tape extends to the downside of the lifting frame after being wetted by the wetting roller. After a carton to be packaged is conveyed to the position of a portal frame and is moved to the position of the extended wet tape, the wet tape is stuck to a gap between two sealing plates of the carton and is driven to move with the carton.

9 Claims, 25 Drawing Sheets

(56) References Cited

U.S. PATENT DOCUMENTS 5,188,271 A * 2/1993 Dannatt ..... G07B 17/00508 226/110
5,478,430 A * 12/1995 Marchetti ..... B65B 51/067 156/578
5,626,708 A * 5/1997 Vasilakes ..... B65G 39/12 156/468
5,635,018 A * 6/1997 Gu ..... B65H 35/0013 156/468
5,730,831 A * 3/1998 Jensen, Jr. ..... B65B 51/067 198/860.1
5,759,338 A * 6/1998 Marchetti ..... B65B 51/067 156/468
5,904,805 A * 5/1999 Marchetti ..... B65B 51/067 156/577
5,916,106 A * 6/1999 Chen ..... B65B 51/067 53/378.3
2014/0026810 A1* 1/2014 Lazzaroni ..... B65H 35/0046 118/231
2022/0089308 A1* 3/2022 Monti ..... B65B 57/04
2022/0161505 A1* 5/2022 Hivatal ..... B29C 65/4825
2022/0204306 A1* 6/2022 Huang ..... B65H 35/0086
2023/0182945 A1* 6/2023 Monti ..... B65B 61/06 156/468
2023/0382056 A1* 11/2023 Walker ..... B65B 51/067
2024/0010375 A1* 1/2024 Jarrell ..... B65B 7/2842
2025/0026523 A1* 1/2025 Menta ..... B65B 61/06

FOREIGN PATENT DOCUMENTS

CN 210708176 U 6/2020
CN 211468970 U 9/2020
CN 114834697 A * 8/2022
CN 116986048 A * 11/2023
CN 117141850 A * 12/2023
KR 200408077 Y1 * 2/2006 ..... B65B 43/42

* cited by examiner

CARTON SEALER ADOPTING WET TAPE

TECHNICAL FIELD

The present disclosure relates to the field of packing equipment, in particular to a carton sealer adopting a wet tape.

BACKGROUND

Packing is a necessary condition for products to enter the field of circulation, and the main means for achieving packing is to pack the products by using cartons, but the cartons need to be sealed with a tape. With the development of science and technology, most of steps of tape sealing are performed by using a carton sealer instead of manual work, so that the packing efficiency is increased.

Most of current carton sealers adopt self-adhesive tapes such as transparent tapes. The viscosity of such self-adhesive tapes is lower than that of wet tapes. However, all of the current carton sealers are not applicable to carton sealing performed by adopting the wet tapes so as not to be applicable to the carton sealing performed by adopting the wet tapes.

SUMMARY

For overcoming defects proposed in the above-mentioned background art, the present disclosure provides a carton sealer adopting a wet tape to overcome the problem that the current carton sealer is not applicable to a wet tape.

The present disclosure adopts the following technical solution:

provided is a carton sealer adopting a wet tape, wherein the carton sealer includes:

a conveyor, the conveyor being used for conveying a carton to be packaged;

a portal frame, the portal frame including upright columns and a lifting frame, the upright columns being fixed on two sides of the conveyor, the lifting frame being connected between, the two upright columns, and the lifting frame lifting relative to the conveyor;

an unwinding device, the unwinding device including an outer shaft, the outer shaft being connected to one side of the lifting frame to rotate, and a tape roll sleeving the outer shaft so that the tape roll is fixed relative to the outer shaft;

a tape conveying device, the tape conveying device including an upper conveying roller, a lower conveying roller and a tape conveying motor, the upper conveying roller and the lower conveying roller being both connected to the lifting frame to rotate, and the tape conveying motor being fixed on one side of the lifting frame to drive the lower conveying roller to rotate;

a tape cutting device, the tape cutting device including a cutter holder and a movable blade, the cutter holder being fixed on the lifting frame, the cutter holder being provided with a tape through hole, and the movable blade moving relative to the tape through hole;

a wetting device, the wetting device including a second water tank and a wetting roller, the second water tank being fixed on the lifting frame, water being contained in the second water tank, the wetting roller being connected to the second water tank to rotate, and one surface of the wetting roller being immersed into the water in the second water tank;

wherein after passing through a space between the upper conveying roller and the lower conveying roller, a tape pulled out of a tape roll mounted on the unwinding device sequentially passes through the movable blade of the tape cutting device, passes by the wetting roller of the wetting device, and then extends out of the downside of the lifting frame.

In a possible implementation, first slide blocks sliding vertically are disposed in the two upright columns, the portal frame is provided with a beam between, the two upright columns, two ends of the beam are respectively fixed to the two first slide blocks, and the lifting frame is fixedly connected with the beam.

In a possible implementation, first driving cylinders are further fixed in the upright columns, telescopic rods of the first driving cylinders are vertically telescopic and are fixed to the first slide blocks, and the telescopic rods of the two first driving cylinders do telescopic movement synchronously.

In a possible implementation, first lead screws disposed vertically are further connected in the upright columns and are limited to be only capable of rotating in the upright columns, and the first lead screws spirally pass through the first slide blocks; and chain wheels are fixed on upper ends of the first lead screws, and the chain wheels on the upper ends of the first lead screws of the two upright columns are both engaged with the same chain.

In a possible implementation, two sides of the conveyor are both provided with strip-shaped limiting mechanisms, the carton to be packaged is limited to move between the two limiting mechanisms, and the two limiting mechanisms synchronously move to the middle or two sides of the conveyor.

In a possible implementation, the conveyor is a roller conveyor, connecting columns are fixed on two ends of each of the limiting mechanisms, and second supports are fixed after the connecting columns pass through a gap between the two rollers of the conveyor; and two ends of the conveyor are both, connected with second lead screws below the rollers, two ends of the second lead screws are provided with external threads opposite in direction, and the two external threads are respectively in threaded connection with the second supports on the same ends of the two limiting mechanisms.

In a possible implementation, the two second lead screws are both fixedly provided with second chain wheels in a rack of the conveyor, and the two second chain wheels are both engaged and connected with a second chain.

In a possible implementation, an end of one of the second lead screws is fixedly connected with a second handle after penetrating out of the rack of the conveyor.

In a possible implementation, the tape conveying device further includes an upper pressing plate and a lower pressing plate, the lower pressing plate is fixed on the lifting frame, and the upper pressing plate rotates relative to the lower pressing plate; and each of the upper pressing plate and the lower pressing plate is provided with an avoidance gap, the lower conveying roller is located below the lower pressing plate, an upper surface of the lower conveying roller passes through the avoidance gap of the lower pressing plate, the upper conveying roller is located above the upper pressing plate, a lower surface of the upper conveying roller passes through the gap of the upper pressing plate, and a tape passes through a space between the upper pressing plate and the lower pressing plate and the space between the upper conveying roller and the lower conveying roller.

In a possible implementation, the tape conveying device further includes a swing frame, a second swing shaft is fixed on one side of the swing frame, and the second swing shaft passes through the lifting frame and is limited to rotate relative to the lifting frame; and the second swing shaft is fixedly provided with a swing arm on the other side of the lifting frame, and the swing arm is fixed after swinging relative to the lifting frame with the second swing shaft as an axis.

In a possible implementation, the carton sealer farther includes a tape pressing device, the tape pressing device includes torsion frames and guide rollers, a third swing shaft is fixed on a side, connected with the second water tank, of the lifting frame, one end of each of the two torsion flames is connected to the third swing shaft to rotate, the guide rollers are connected to ends, close to the second water tank, of the two torsion frames, and a surface, facing away from an initial end of the conveyor, of the wet tape is stuck to the two guide rollers; and the third swing shaft is sleeved with torsional springs, two ends of the torsional springs respectively extend into the two torsion frames, the lifting frame is fixedly provided with a stop lever on the torsion frame located above, and the stop lever stops the torsion frame located above, so that the torsion frame located below swings downwards under the action of torsions of the torsional springs.

It can be known from the description for the structure of the present disclosure, compared with the prior art, the present disclosure has the following advantages: in the structure of the present disclosure, the height of the lifting frame relative to the conveyor can be adjusted by adjusting the height of the beam of the portal frame, so that the unwinding device, the tape conveying device, the tape cutting device and the wetting device can ascend or descend to a height close to that of the carton. During operation, after passing through the space between the upper conveying roller and the lower conveying roller, the tape pulled out of the tape roll mounted on the unwinding device sequentially passes through the tape through hole of the tape cutting device, passes by the wetting roller of the wetting device, and extends out of the downside of the lifting frame. During work, the tape is cut off the tape cutting device, and the cut tape extends to the downside of the lifting frame after being wetted by the wetting roller. After the carton to be packaged is conveyed to the position of the portal frame and is moved to the position of the extended wet tape, the wet tape is stuck to a gap between two sealing plates of the carton and is driven to move with the carton, so that the carton is stuck by using the wet tape wetted after being cut off the movable blade, and then, a carton sealing process is formed. Thus, it can be seen that, according to the present disclosure, the tape can be automatically wetted to form the wet tape during the conveyance of the tape, the carton can be sealed by the wet tape, and therefore, the carton sealer is applicable to the carton sealing performed by using the wet tape. Moreover, in the present disclosure, the height of carton sealing performed by using the wet tape can also be adjusted by adjusting the height of the lifting frame, and therefore, the carton sealer has wide applicability.

DETAILED DESCRIPTION OF THE EMBODIMENTS

Figure 1:
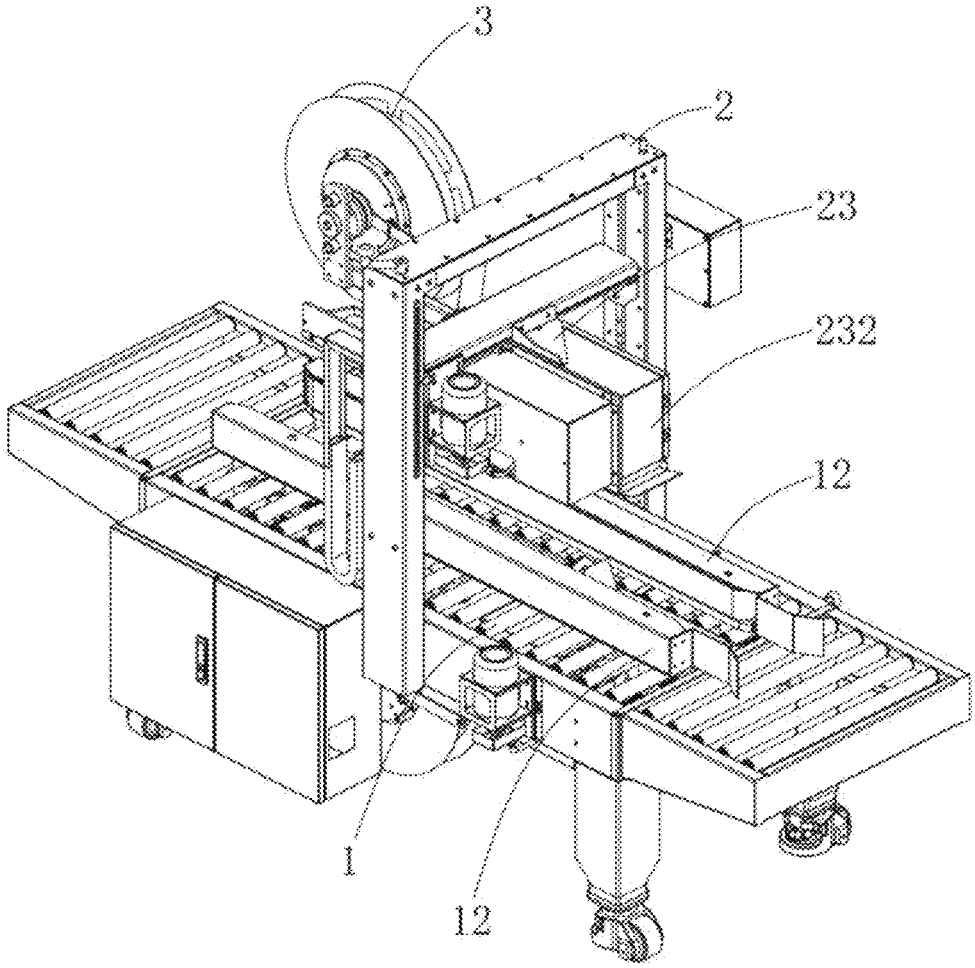
FIG. 1 is a schematic view of a three-dimensional structure of the present disclosure.

In order to make objectives, technical solutions and advantages of the present application clearer, the present application will be further described, in detail below in conjunction with the accompanying drawings.

Below, terms such as "first" and "second" are for descriptive purposes only, and cannot be understood as indicating or implying the relative importance or implicitly indicating the number of indicated technical features. Therefore, the features defined as "first" and "second" may explicitly or implicitly include at least one of the features.

In addition, in the present application, directional terms such as "upper" and "lower" are defined relative to directions where components are schematically placed in the accompanying drawings. It should be understood that these directional terms are relative concepts, are used for relative description and clarification, and can be changed accordingly according to the change of the directions where the components are placed in the accompanying drawings.

The present disclosure discloses a carton sealer adopting a wet tape, as shown in FIG. 1 to FIG. 4, the carton sealer includes a conveyor 1, a portal frame 2, an unwinding device 3, a tape conveying device 7, a tape cutting device 5, a wetting device 4 and a control system. The portal frame 2 includes upright columns 21 and a lifting frame 23, the upright columns 21 are fixed on two sides of the conveyor 1, the lifting frame 23 is connected between the two upright columns 21, the lifting frame 23 lifts relative to the conveyor 1, and the lifting frame 23 is also provided with the unwinding device 3, the tape conveying device 7, the tape cutting device 5 and the wetting device 4 and is used for packaging a tape on an upper surface of a carton conveyed to the position of the portal frame 2. It is worth mentioning that dustproof covers 232 are mounted on two sides of the lifting frame 23, and the tape conveying device 7, the tape cutting device 5 and the wetting device 4 are all disposed in the dustproof covers 232.

Figure 5:
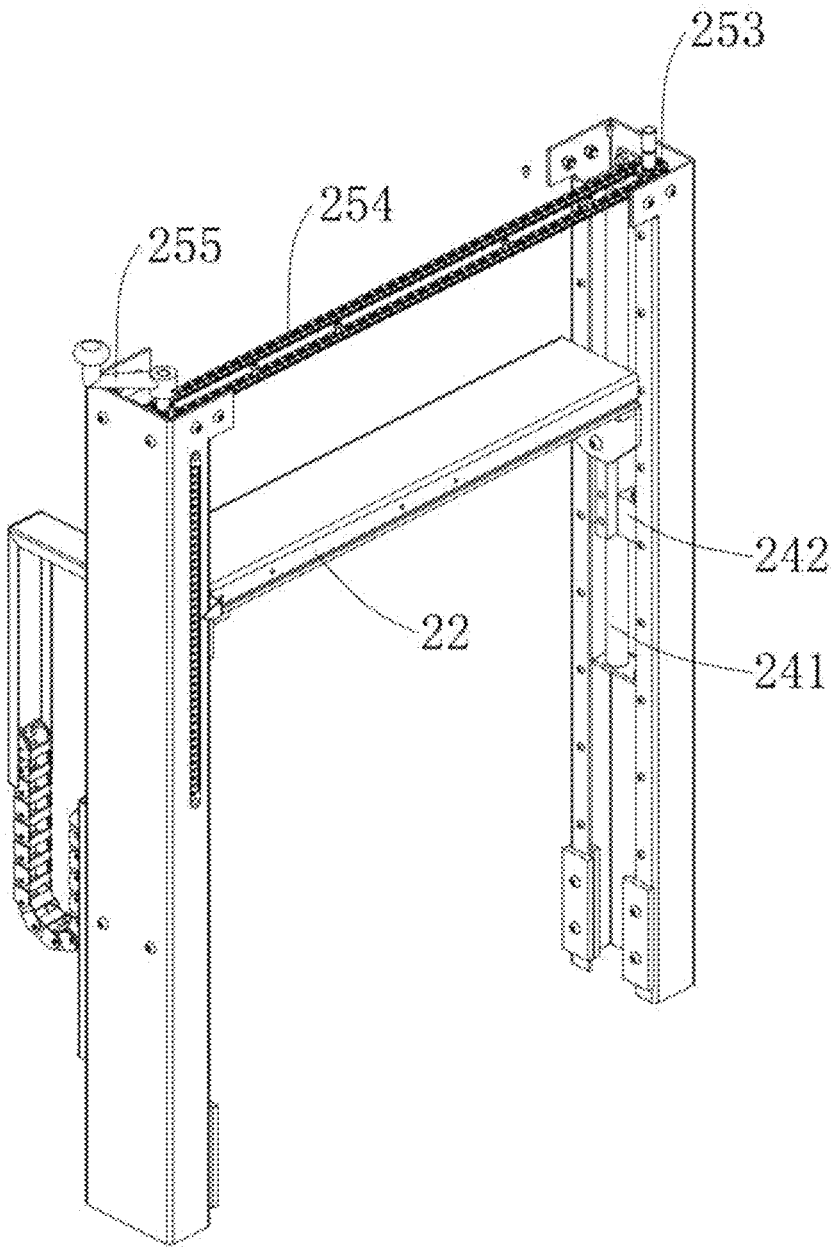
FIG. 5 is a schematic view of a three-dimensional structure for connection between a portal frame and a beam.
Figure 6:
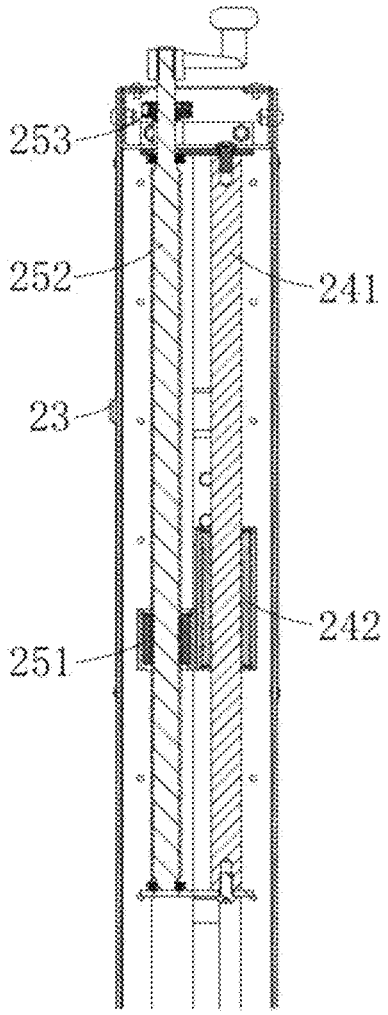
FIG. 6 is a schematic view of a sectional structure of an internal structure of an upright column of the portal frame.

As shown in FIG. 5 and FIG. 6, first slide blocks 24 sliding vertically are disposed in the two upright columns 21, specifically, first guide rods 241 disposed vertically may be fixed in the upright columns 21, linear bearings are nested in the first slide blocks 24, and the linear bearings in the first slide blocks 24 are adapted and sleeved outside the first guide rods 241 so as to limit the first slide blocks 24 to be only capable of vertically sliding relative to the upright columns 21 and the conveyor 1. The portal frame 2 is further provided with a beam 22 between the two upright columns 21, and two ends of the beam 22 are respectively fixed to the first slide blocks 24 of the two upright columns 21. The lifting frame 23 is fixedly connected with the beam 22 to form a structure that the unwinding device 3, the tape conveying device 7, the tape cutting device 5 and the wetting device 4 lift relative to the conveyor 1, and all fixed structures in the present implementation can be fixed by threaded connection performed by mounting bolts, Due to the adoption of such a structure, the height of the lifting frame 23 relative to the conveyor 1 can be adjusted according to a carton at a different height, so that the unwinding device 3, the tape conveying device 7, the tape cutting device 5 and the wetting device 4 can ascend or descend to a height close to that of the carton to package the carton at the different height by using a wet tape, and therefore, the structure has wide applicability. Preferably, a side of one of the upright columns 21 of the portal frame 2 is further fixedly provided with scales used for observing the height of the adjusted lifting frame 23 relative to the conveyor 1, so that a working staff can more intuitively observe a height required to be adjusted.

A way of driving the two first slide blocks 24 to lift may be shown in FIG. 6, first supports 251 are fixed on sides of the first slide blocks 24 in the upright columns 21, first lead screws 252 disposed vertically are further connected in the upright columns 21, bearings are fixed on upper and lower ends of the first lead screws 252 in the upright columns 21, and two ends of the first lead screws 252 are respectively nested and fixed in inner rings of the two bearings, so that the first lead screws 252 are limited to be only capable of rotating in the upright columns 21. The first lead screws 252 further spirally pass through the first slide blocks 24, so that the first lead screws 252 rotate to drive the first slide blocks 24 to ascend or descend. In addition, first chain wheels 253 are fixed after upper ends of the first lead screws 252 penetrate out of the bearings, and the first chain wheels 253 on upper ends of the first lead screws 252 of the two upright columns 21 are both engaged with a first chain 254. During operation, by rotating one of the first lead screws 252, the first chain 254 can drive the other first lead screw 252 to synchronously rotate in the same direction, so that the first slide blocks 24 in the two upright columns 211 synchronously ascends or descends, and then, the lifting of the lifting frame 23 relative to the conveyor 1 is achieved. Further, a way of rotating the first lead screws 252 may be that a motor is fixed on the top of each of the upright columns 21, or a first handle 255 is fixed on the top of one of the first lead screws 252, and the first lead screw 252 can be driven to rotate by rotating the first handle 255.

Figure 2:
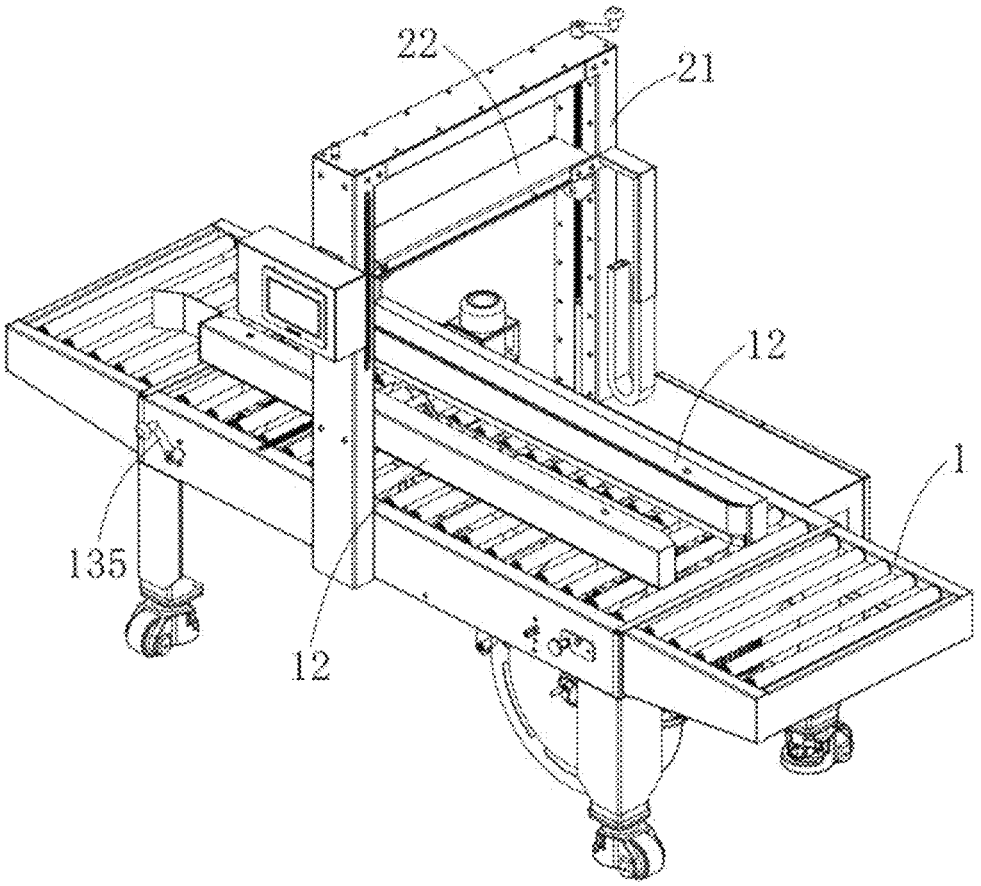
FIG. 2 is a schematic view shown after a lifting frame is hidden in FIG. 1.
Figure 3:
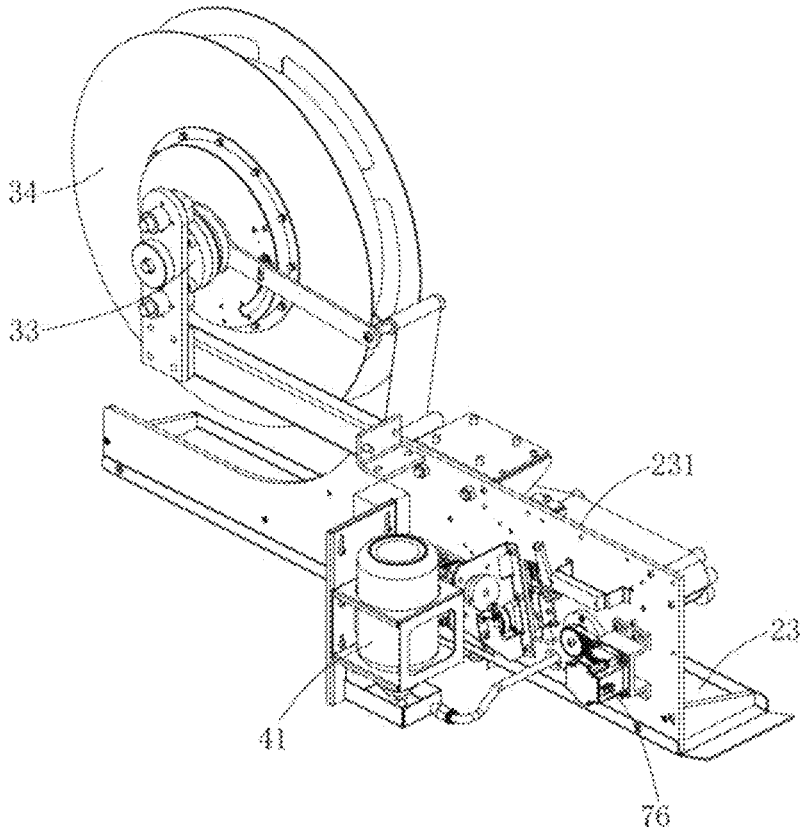
FIG. 3 is a schematic view of a three-dimensional structure of the lifting frame with dustproof covers being hidden.
Figure 4:
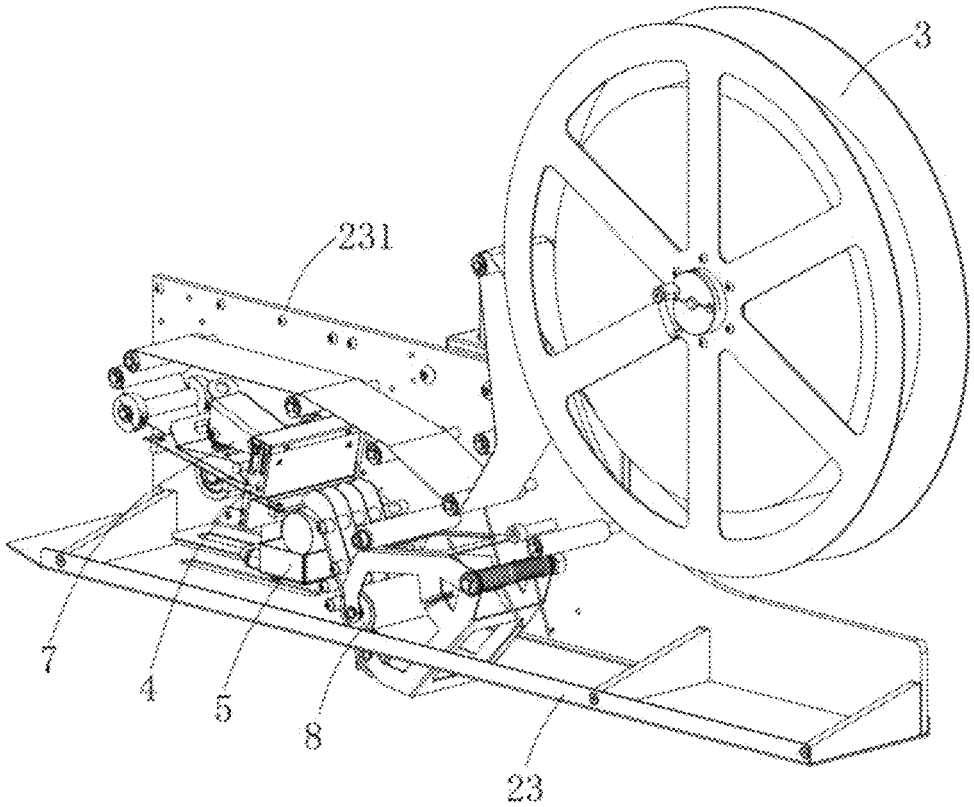
FIG. 4 is a schematic view of a three-dimensional structure viewed from the other side in FIG. 3.
Figure 9:
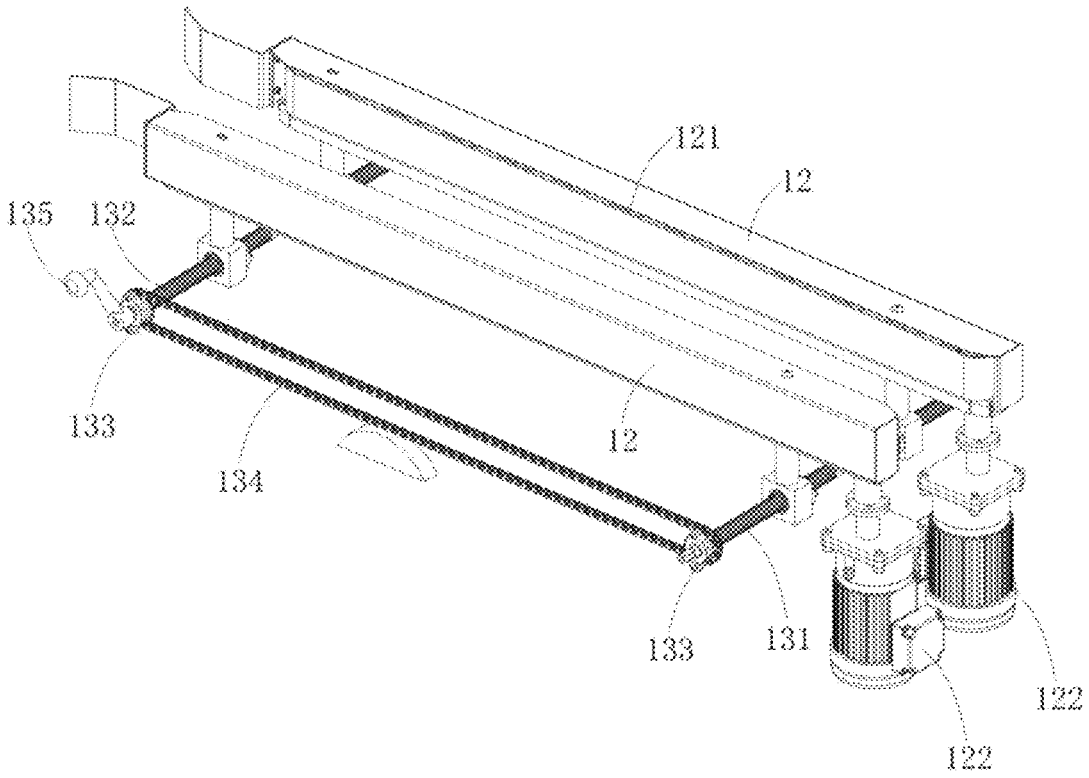
FIG. 9 is a schematic view of a three-dimensional structure of two limiting mechanisms.

Further refer to FIG. 1 and FIG. 2, two sides of the conveyor 1 are both provided with strip-shaped limiting mechanisms 12, and structures of the limiting mechanisms 12 may be belt conveyors with conveying belts 121 being disposed on sides as shown in FIG. 9, the carton to be packaged is limited to move between the conveying belts 121 of the two limiting mechanisms 12, so that the carton is kept to be conveyed in the middle below the lifting frame 23. The two limiting mechanisms 12 synchronously move to the middle or two sides of the conveyor 1, that is, the two limiting mechanisms 12 move relative to the conveyor 1 in a mirroring way so as to be adjusted for the carton at the deferent height. Preferably, a side, facing the outer side of the conveyor 1, of one of the limiting mechanisms 12 is further fixedly provided with scales used for observing a distance from the adjusted limiting mechanism 12 to an outer edge of the conveyor 1, so that the working staff can more intuitively observe a width formed between the two adjusted limiting mechanisms 12.

Figure 7:
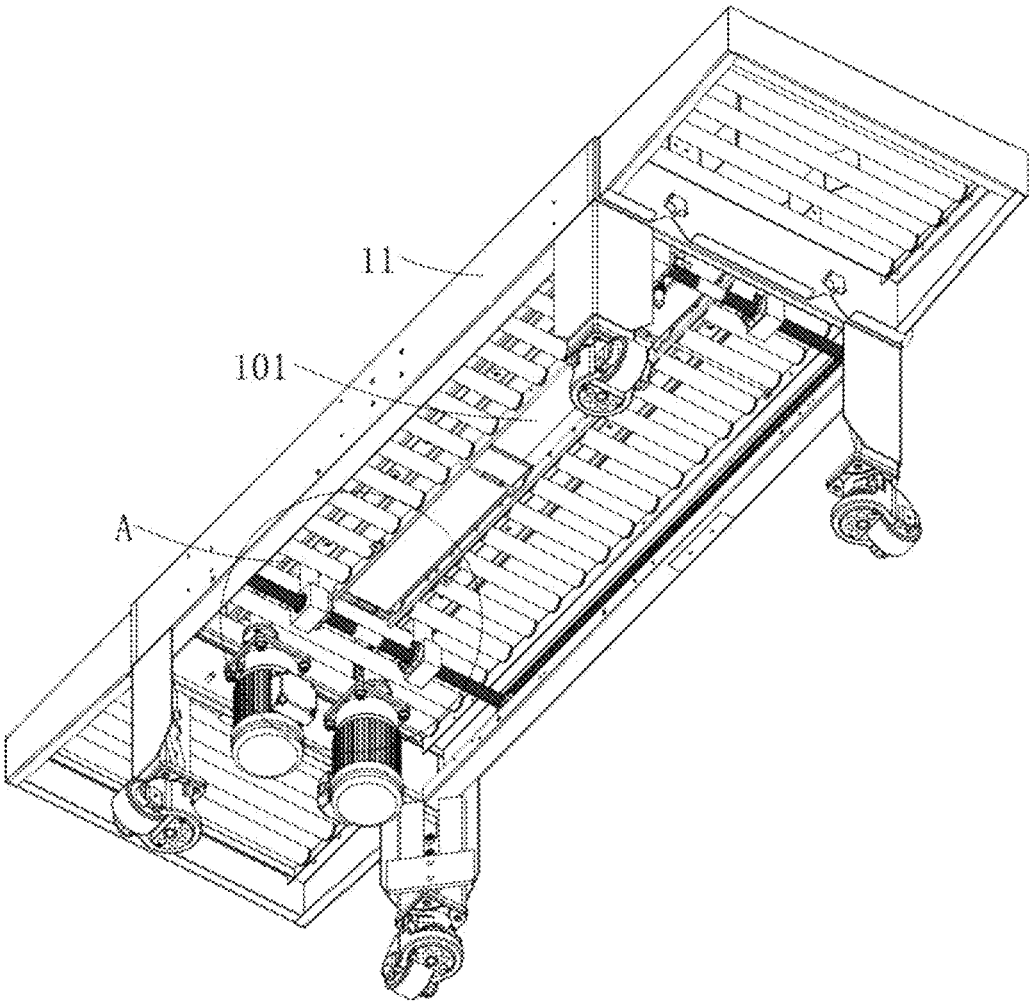
FIG. 7 is a schematic view of a three-dimensional structure viewed from the bottom of a conveyor.
Figure 8:
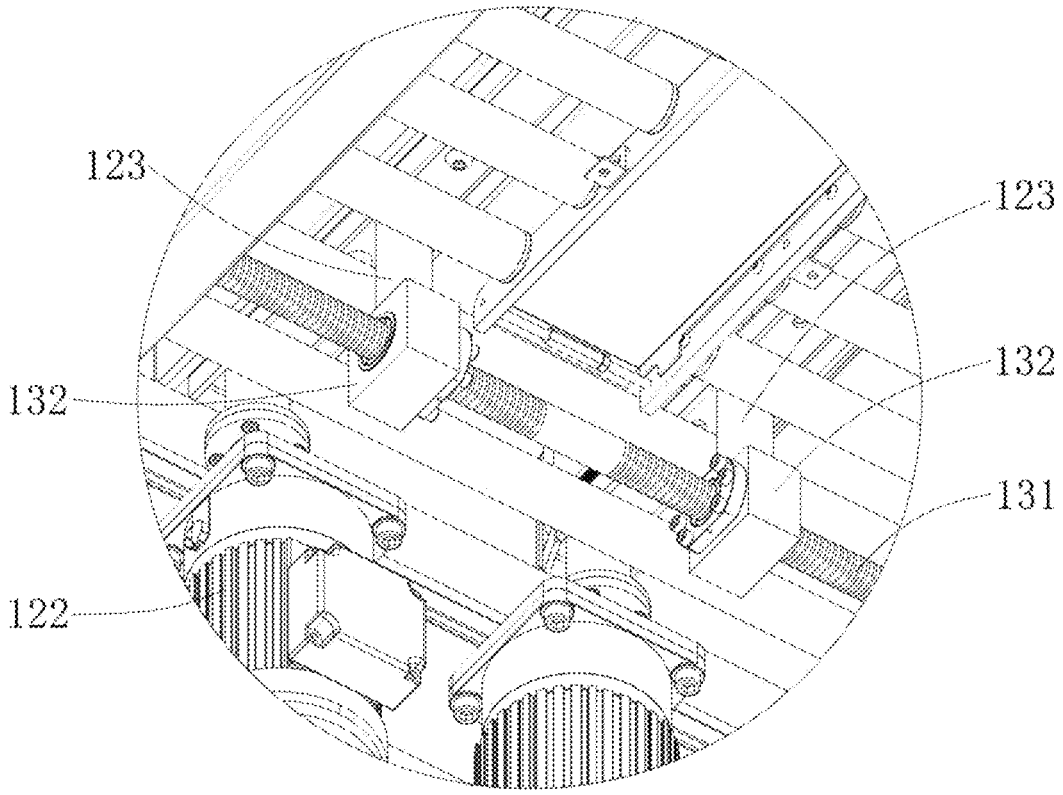
FIG. 8 is a schematic enlarged view of part A in FIG. 7.

Further refer to FIG. 7 to FIG. 9, the conveyor 1 is a roller conveyor, connecting columns 123 are fixed on two ends of each of the limiting mechanisms 12, and second supports 132 are fixed after the connecting columns 123 pass through a gap between the two rollers of the conveyor 1, and the second supports 132 and the first supports 251 are consistent and can be both nut supports adapted to lead screws in the prior art. Two ends of the conveyor 1 are both connected with second lead screws 131 below the rollers, specifically, two ends of the second lead screws 131 are respectively fixed to two first bearing blocks, and the two first bearing blocks are respectively fixed to two sides inside a rack 11, so that the second lead screws 131 are limited to axially and fixedly rotate in the rack 11. Two ends of the second lead screws 131 are provided with external threads opposite in spiral direction, and the two external threads are respectively in threaded connection with the second supports 132 on the same ends of the two limiting mechanisms 12, so that the second lead screws 131 can drive the two second supports 132 to move to the middle or two sides of the conveyor 1 at the same time during rotation.

Further refer to FIG. 7 to FIG. 9, second chain wheels 133 are both fixed on ends, located in the rack 11, of the two second lead screws 131, the two second chain wheels 133 are both engaged and connected with a second chain 134, and the two second lead screws 131 synchronously rotate under the driving of the second chain 134. Further, an end of one of the second lead screws 131 is fixedly connected with a second handle 255 after penetrating out of the rack 11. During operation, by rotating the second handle 255, the two second lead screws 132 can be driven to synchronously rotate, so that the two limiting mechanisms 12 synchronously move to the middle or two sides. This operation way is very convenient.

Figure 10:
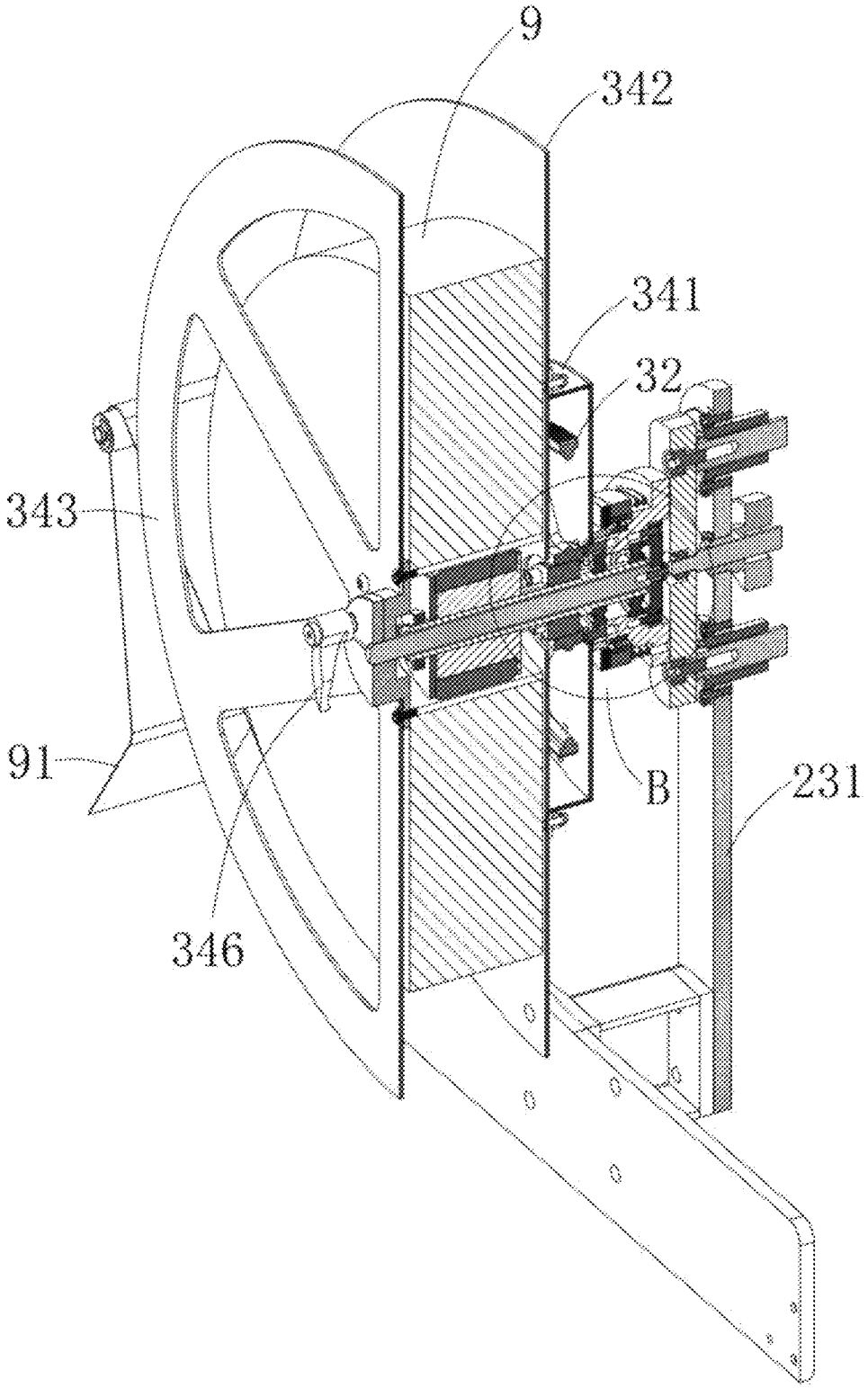
FIG. 10 is a schematic view of a three-dimensional sectional structure of an unwinding device.
Figure 11:
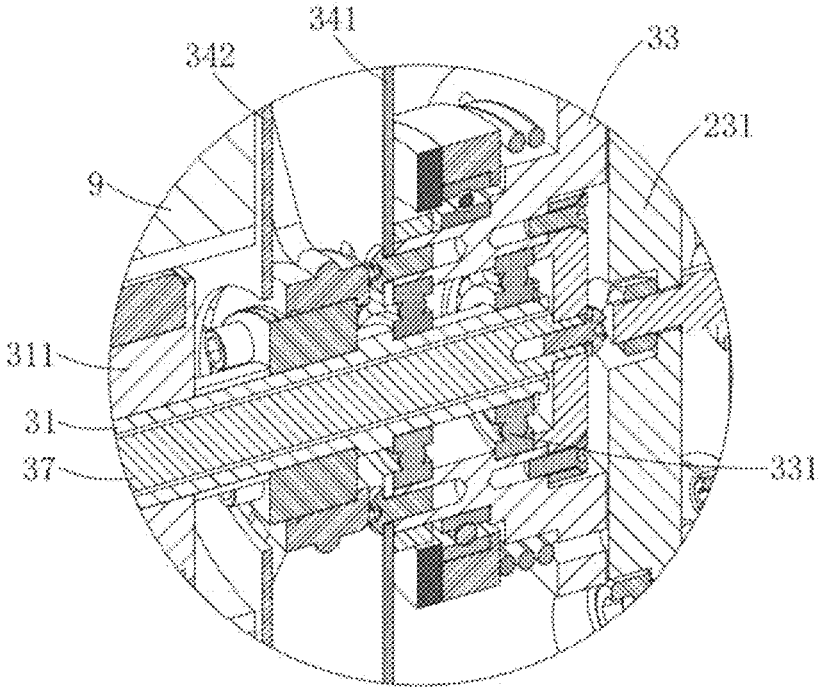
FIG. 11 is a schematic enlarged view of part B in FIG. 10.

As shown in FIG. 10 and FIG. 11, the unwinding device 3 includes an outer shaft 31, a central shaft 37 and a protective cover 34. A bearing block 33 is fixed on the lifting frame 23, a first bearing 331 is fixed in the bearing block 33, the outer shaft 31 is connected with an inner ring of the first bearing 331 in an interference fit way, and a way that the outer shaft 31 rotates relative to the lifting frame 23 can be formed by such a connection structure of the bearing block 33. In addition, the protective cover 34 is also fixed to the lifting frame 23 by the connection of the bearing block 33, specifically, the protective cover 34 includes a second protective plate 342 and an outer cover 341 and a second protective plate 343 which are respectively disposed on two surfaces of the first protective plate 342, the outer cover 341 is fixed to the bearing block 33, and the first protective plate 342 and the outer cover 341 are fixed, so that the first protective plate 342 is fixed on the lifting frame 23. The outer shaft 31 is fixed and connected with the first bearing 331 in the bearing block 33 after penetrating into the first protective plate 342, so that a structure that the outer shaft 31 rotates relative to the lifting frame 23 is formed. An expansion sleeve 311 is further fixed outside the outer shaft 31, and a through hole in the center of a tape roll 9 sleeves a cylindrical surface outside the expansion sleeve 311 for fixation, so that the tape roll 9 is fixed relative to the outer shaft 31, and then, the rotation of the tape roll 9 relative to the lifting frame 23 is achieved.

Further refer to FIG. 10 and FIG. 11, a second protective plate 343 is fixed on the other end, opposite to the first protective plate 342, of the outer shaft 31, the tape roll 9 is located between the first protective plate 342 and the second protective plate 343, which plays a role in protecting the tape roll 9, and thus, the tape roll 9 is prevented from falling off. The structure that the second protective plate 343 is fixed on the other end of the outer shaft 31 can be mounted by a clamping part 344, a conical sleeve handle 346 and a central shaft 37. An end surface on one end of the central shaft 37 is fixedly connected with the bearing block 33 so as to be fixed relative to an unwinding frame 1, and the other end of the central shaft 37 passes through the outer shaft 31. Specifically, an end surface on one end of the central shaft 37 is fixedly connected with the bearing block 33 so as to be fixed relative to the lifting frame 23, and the other end of the central shaft 37 passes through the outer shaft 31. The clamping part 344 is fixed in the middle of the second protective plate 343, a connecting hole 345 is formed in the center of the clamping part 344, and the connecting hole 345 is adapted to clamp an end, penetrating out of the outer shaft 31, of the central shaft 37. A cutting groove 3441 is disposed in one side of the clamping part 344, and the cutting groove 3441 may be a cut which is formed by inwards transverse cutting or oblique cutting from one side of the clamping part 344 and extends to the connecting hole 345. A notch 3442 is further formed in a position along a radius line of the clamping part 344, and the notch 3442 communicates with the connecting hole 345 and the cutting groove 3441, so that a part, facing away from the second protective plate 343 after the clamping part 344 is separated by the cutting groove 3441 and the notch 3442, of the clamping part 344 forms a clamping piece 3443: the clamping piece 3443 forms a structure capable of elastically swinging relative to the notch 3442; and after the connecting hole 345 sleeves an end of the central shaft 37, the end of the central shaft 37 can be clamped in the connecting hole 345 by swinging the clamping piece 3443 to one side of the notch 3442, that is, the clamping part 344 and the central shaft 37 can be fixed to each other, so that the second protective plate 343 is fixed relative to the central shaft 37, and then, the second protective plate 343 is mounted and fixed.

Figure 12:
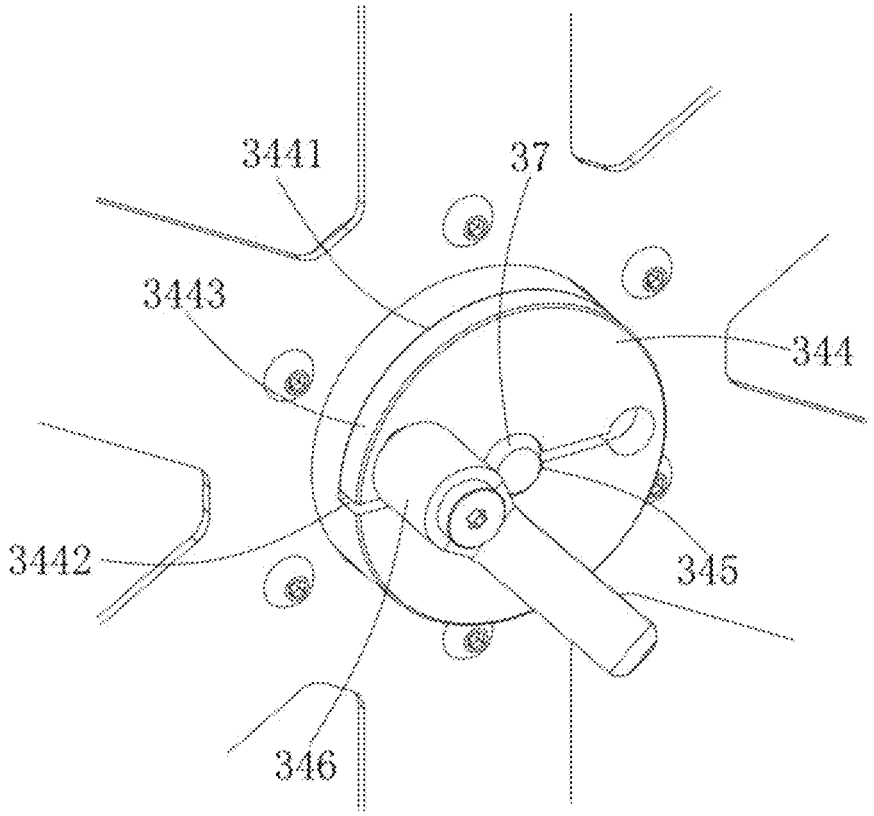
FIG. 12 is a schematic view of a three-dimensional structure for fixed connection between a central part of a second protective plate and a central shaft.
Figure 13:
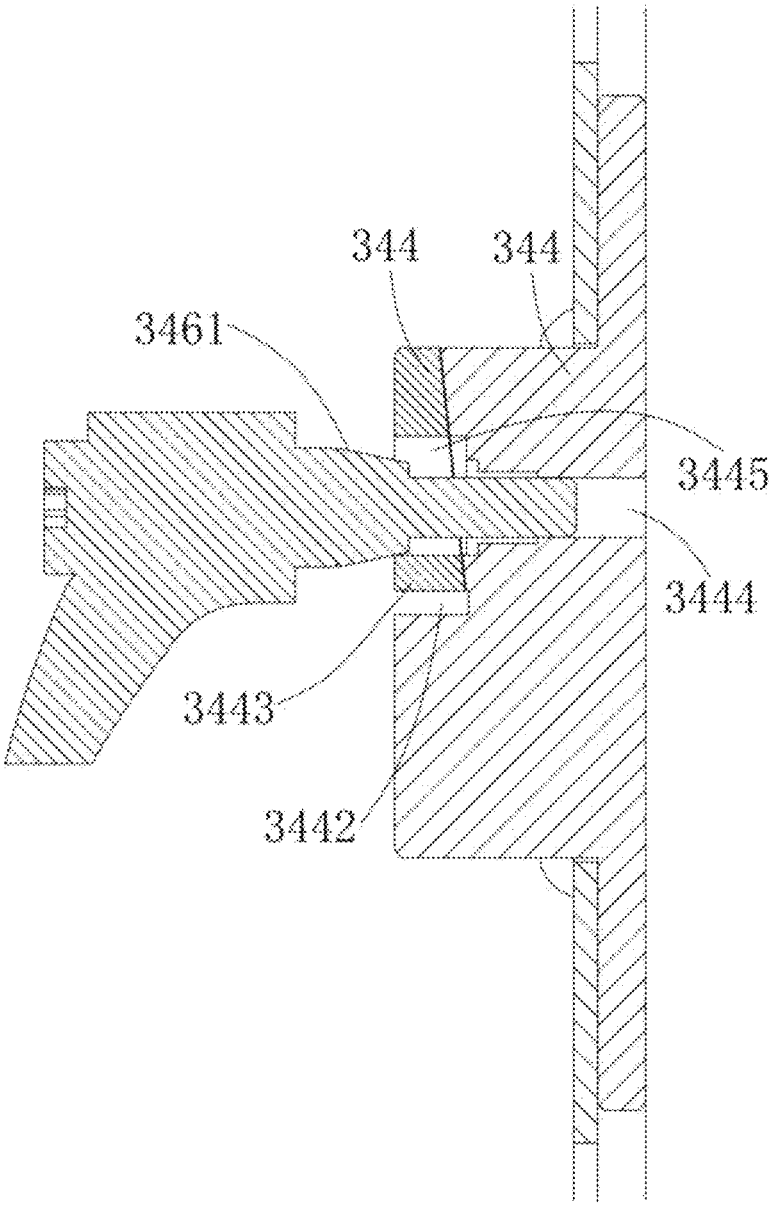
FIG. 13 is a schematic view of a section obtained after a conical sleeve handle is screwed into a threaded hole in a clamping part.

Further refer to FIG. 12 and FIG. 13, the clamping part 344 is provided with a threaded hole 3444, and the conical sleeve handle 346 is adapted, and spirally connected with the threaded hole 3444. The clamping piece 3443 is provided with a moving hole 3445 in a side of the notch 3442, and the moving hole 3445 and the threaded hole 3444 are disposed eccentrically (that is, centers of circles are not on the same position). The conical sleeve handle 346 is further provided with a guide part 3461 of a conical structure, and the guide part 3461 is fixed on one end of a stud screwed in the threaded hole 3444; and when the conical sleeve handle 346 is screwed in the threaded hole 3444, the guide part 3461 supports against a side wall of the moving hole 3445 to drive the side, provided with the moving hole 3445, of the clamping piece 3443 to move to the other side of the notch 3442, which ensures that the guide part 3461 is more deeply embedded into the moving hole 3445 when the conical sleeve handle 346 is more tightly screwed in the threaded hole 3444, so that the clamping piece 3443 is driven to move to more tightly clamp the end of the central shaft 37, then, the second protective plate 343 is fixed relative to the central shaft 37, that is, the second protective plate 343 is fixed on the other end, opposite to the first protective plate 342, of the outer shaft 31, and two ends of the outer shaft 31 are respectively provided with the first protective plate 342 and the second protective plate 343 for protecting the tape roll 9.

Figure 14:
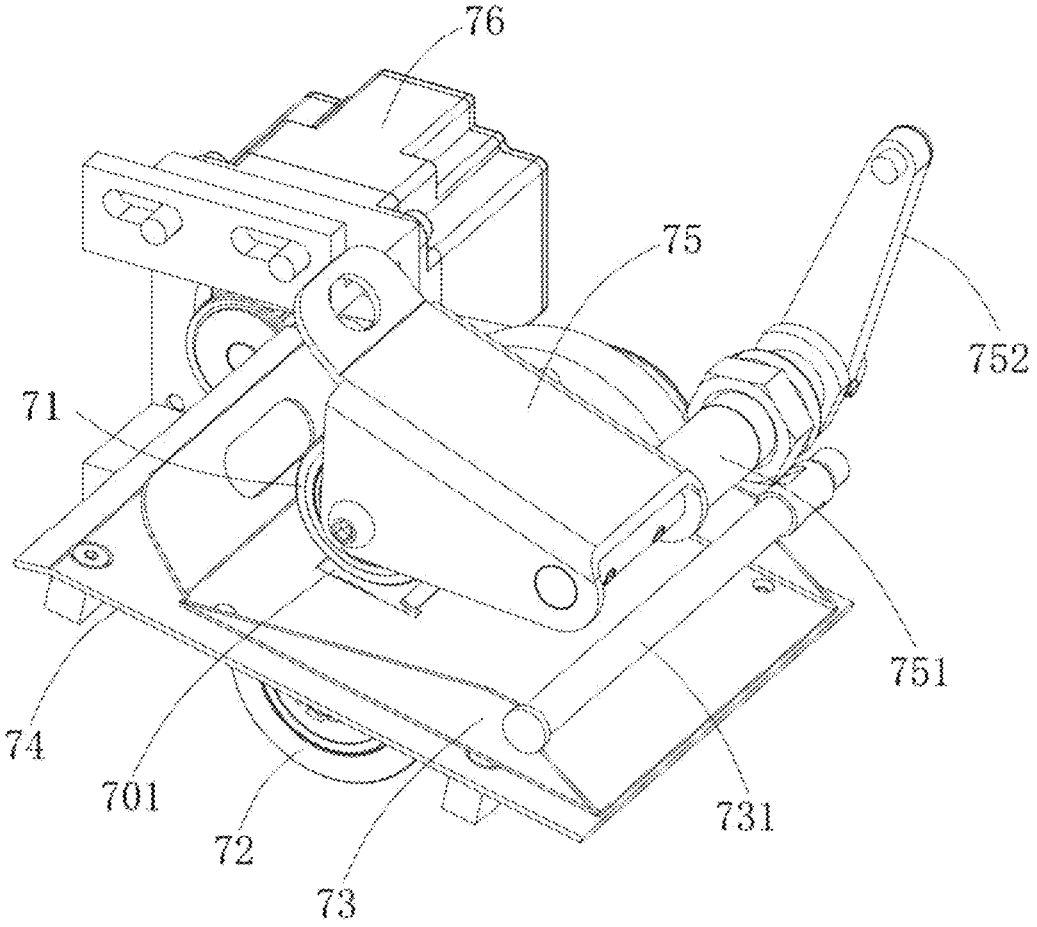
FIG. 14 is a schematic view of a three-dimensional structure of a tape conveying device.
Figure 15:
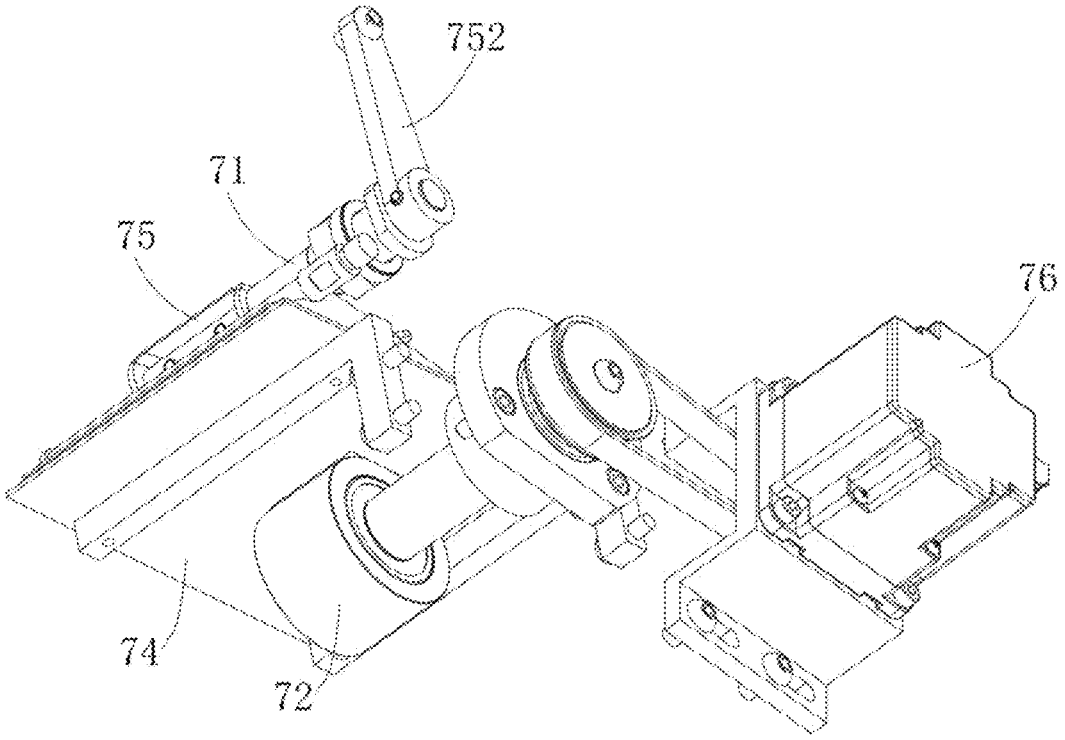
FIG. 15 is a schematic view of a three-dimensional structure viewed from the bottom of the tape conveying device.

As shown in FIG. 14 and FIG. 15, the tape conveying device 7 includes an upper conveying roller 71, a lower conveying roller 72, an upper pressing plate 73 and a lower pressing plate 74. The lower pressing plate 74 is fixed on a side of a vertical plate 231 of the lifting frame 23, and the upper pressing plate 73 is located above the lower pressing plate 74. Each of the upper pressing plate 73 and the lower pressing plate 74 is provided with an avoidance gap 701, the lower conveying roller 72 is located below the lower pressing plate 74, and an upper surface of the lower conveying roller 72 passes through the avoidance gap 7011 of the lower pressing plate 74. The upper conveying roller 71 is located above the upper pressing plate 73, a lower surface of the upper conveying roller 71 presses against the lower conveying roller 72 after passing through the avoidance gap 701 of the upper pressing plate 73, and a tape 91 passes through a space between the upper pressing plate 73 and the lower pressing plate 74 and the space between the upper conveying roller 71 and the lower conveying roller 72.

Figure 22:
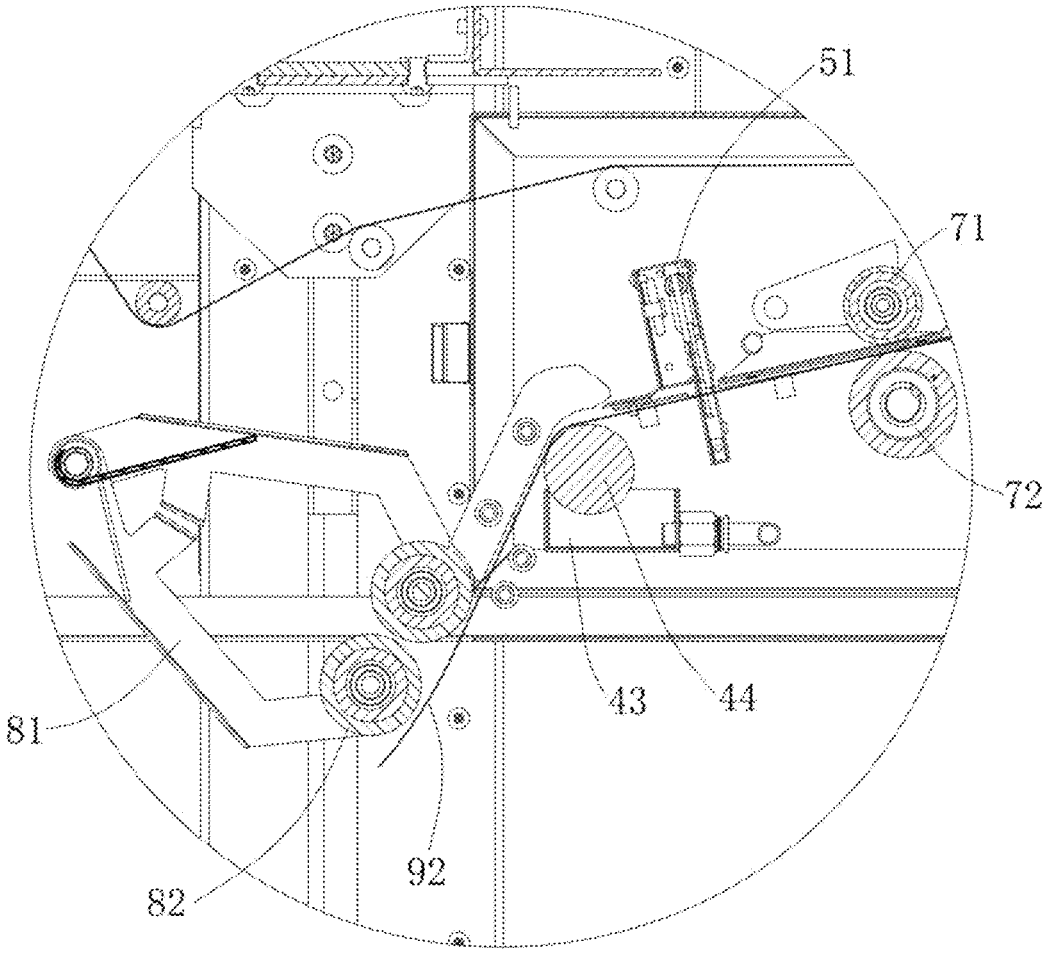
FIG. 22 is a schematic enlarged view of part C in FIG. 21.

Further refer to FIG. 15, the tape conveying device 7 further includes a tape conveying motor 76 fixed on the other side of the vertical plate 231, and an output shaft of the tape conveying motor 76 drives the lower conveying roller 72 to rotate on a position on the other side of the vertical plate 231 in a synchronous belt driving way, so that the tape 91 downwards pressed by the upper conveying roller 71 to be fitted to a surface of the lower conveying roller 72 is driven to be conveyed to the tape cutting device 5, as shown in FIG. 22.

Further, the upper pressing plate 73 and the upper conveying roller 71 both swing relative to the lower pressing plate 74, and the rotating structure may be that a first swing shaft 731 is fixed on an end of the upper pressing plate 73, the first swing shaft 731 passes through the vertical plate 231, and the first swing shaft 731 is spirally connected with limiting sleeves 732 on two ends of the vertical plate 231, so that the first swing shaft 731 is limited to be only capable of rotating relative to the vertical plate 231, and then, the upper pressing plate 73 is limited to be only capable of rotating relative to the lower pressing plate 74, Further refer to FIG. 15, the upper conveying roller 71 is connected with a swing frame 75 to rotate, a second swing shaft 751 is fixed on one side of the swing frame 75, and the second swing shaft 751 passes through the vertical plate 231 and is limited to rotate relative to the vertical plate 231 like the above-mentioned first swing shaft 731; and the second swing shaft 751 is fixedly provided with a swing arm 752 on the other side of the vertical plate 231 of the lifting frame 23, and the swing arm 752 is fixed after swinging relative to the lifting frame 23 with the second swing shaft 751 as an axis, and the fixing way thereof may be that an end of the swing arm 752 is fixed by mounting a screw in the vertical plate 231. Due to the adoption of the above-mentioned structure, when the tape 91 needs to pass through a gap between the lower pressing plate 74 and the upper pressing plate 73, the upper pressing plate 73 is upwards turned by swinging the swing arm 752, and then, the upper conveying roller 71 can be driven to be upward, so that a larger gap is formed between the upper pressing plate 73 and the lower pressing plate 74 to facilitate the passing of the tape 91.

Figure 16:
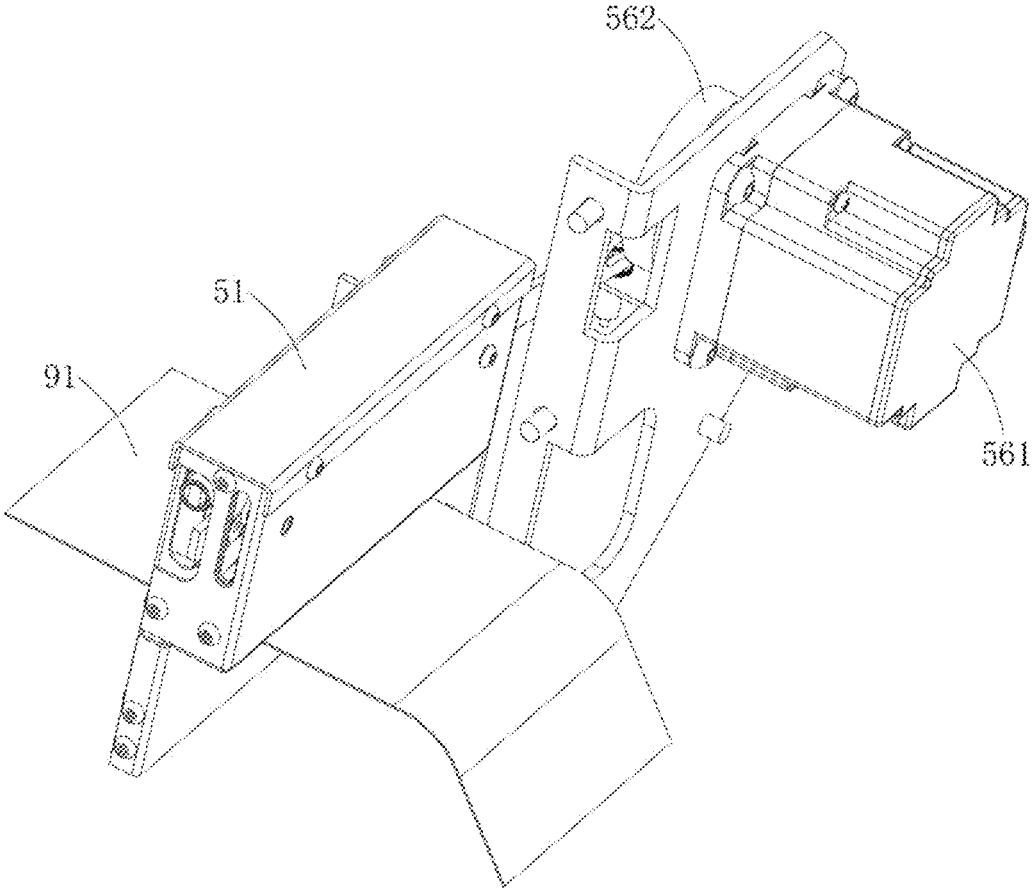
FIG. 16 is a schematic view of a three-dimensional structure of a tape cutting device.
Figure 17:
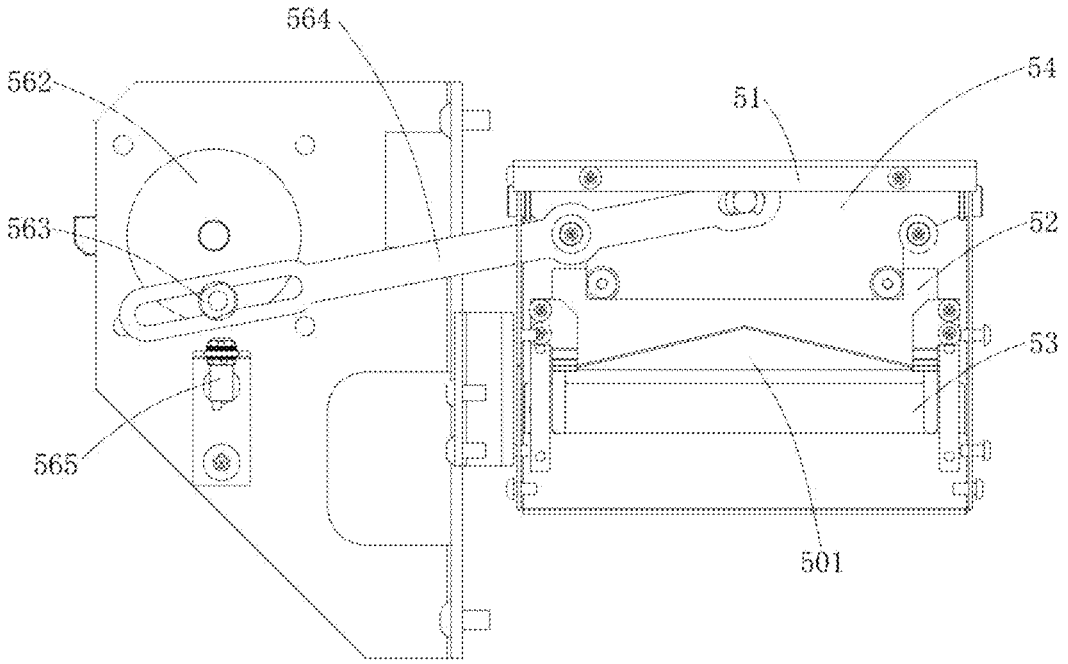
FIG. 17 is a schematic view viewed from the front of an internal structure of the tape cutting device.

As shown in FIG. 16 and FIG. 17, the tape cutting device 5 includes a cutter holder 51, a fixed blade 53 and a movable blade 52, and the cutter holder 51 is fixed on one side of the vertical plate 231 of the lifting frame 23. The cutter holder 51 is provided with a tape through hole 501 allowing the tape 91 to pass through, and the fixed blade 53 and the movable blade 52 are respectively disposed on two sides of the tape through hole 501, wherein the fixed blade 53 is fixed in the cutter holder 51, a sliding seat 54 is slidably connected in the cutter holder 51, the movable blade 52 is fixed to an end, close to the fixed blade 53, of the sliding seat 54, and the movable blade 52 is enabled to slide relative to the fixed blade 53 in the cutter holder 51 to form an action of cutting off the tape 91 passing through the tape through hole 501.

Further refer to FIG. 16 and FIG. 17, the tape cutting device 5 further includes a tape cutting motor 561 driving the movable blade 52 to slide, an eccentric wheel 562 and a swing rod 564, The tape cutting motor 561 is fixed on the other side of the vertical plate 231, the eccentric wheel 562 is fixed on an output shaft of the tape cutting motor 561, and an eccentric pin 563 is fixed on a position, deviated from the center of a circle, on the surface of the eccentric wheel 562, A position close to the middle of the swing rod 564 is limited to rotate relative to the cutter holder 51, which may be specifically that a pin shaft 5641 is fixed on the cutter holder 51 after passing through the swing rod so that the swing rod 564 rotates relative to the cutter holder 51 with the pin shaft 5641 as an axis. One end of the swing rod 564 is limited to rotate relative to the movable blade 52, and a connection way thereof may be that two ends of the swing rod 564 are both provided with waist-shaped holes 5642, and the waist-shaped hole 5642 in one end thereof is sleeved outside the pin shaft 5641 fixed on the sliding seat 54, so that one end of the swing rod 564 rotates relative to the movable blade 52. The waist-shaped hole 5642 in the other end of the swing rod 564 is sleeved outside the eccentric pin 563, so that the other end of the swine rod 564 is limited to rotate relative to the eccentric pin 563. When the control system controls the tape cutting motor 561 to work, the tape cutting motor 561 drives the eccentric wheel 562 to rotate so as to drive the eccentric pin 563 to rotate, and the eccentric pin 563 rotates to push parts of the waist-shaped holes 5642 in the swing rod 564 to swing up and down, so that the swing rod 564 swings to drive the movable blade 52 to slide to the fixed blade 53 or a direction away from the fixed blade 53 to cut off the tape 91 and abdicate a space, so that the tape 91 is further conveyed forwards after passing through the tape through hole 501.

Figure 18:
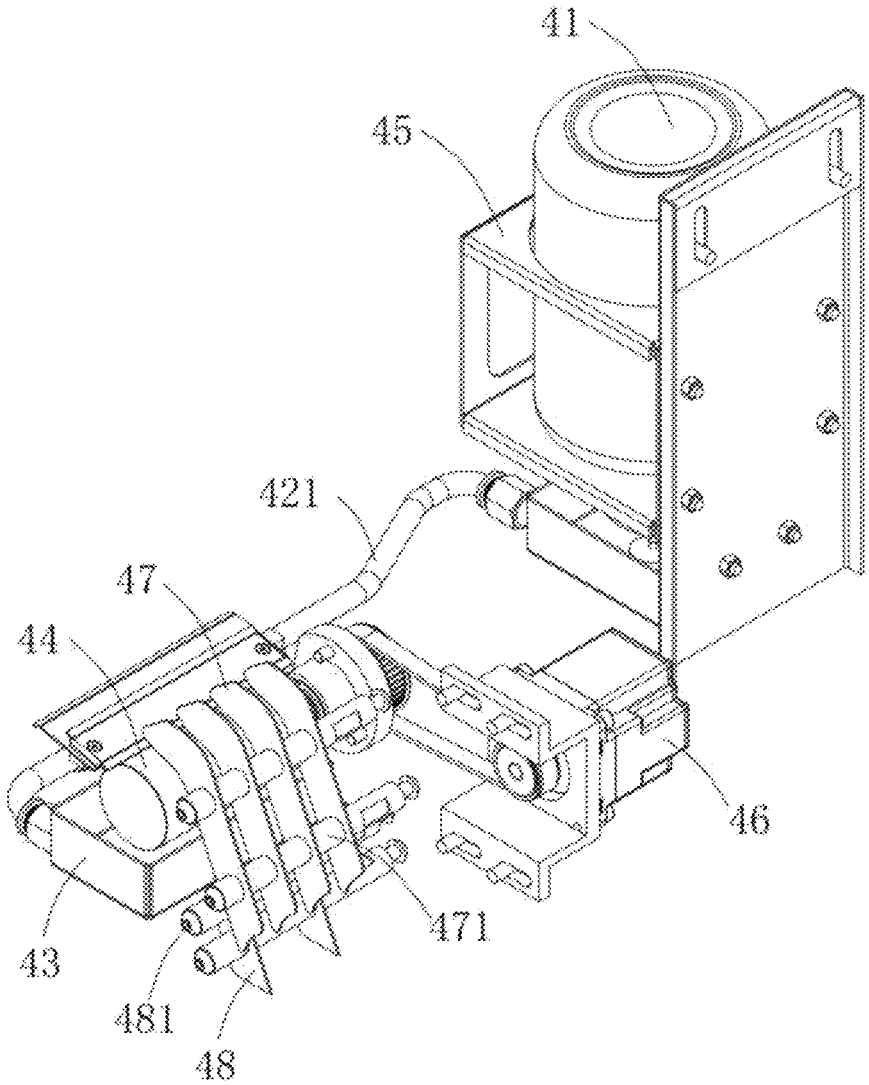
FIG. 18 is a schematic view of a three-dimensional structure of a wetting device.
Figure 19:
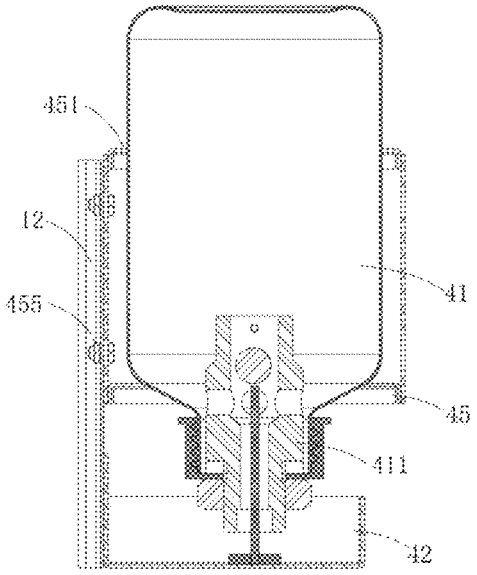
FIG. 19 is a schematic view of a sectional structure of a water containing bottle placed on a water replenishing frame.

As shown in FIG. 18 to FIG. 19, the wetting device 4 includes a second water tank 43 and a wetting roller 44, the second water tank 43 is fixed on one side of the vertical plate 231 of the lifting frame 23, water is contained in the second water tank 43, one end of the wetting roller 44 is connected to one side of the vertical plate 231 to rotate, one surface of the wetting roller 44 is immersed into the water in the second water tank 43, the other end of the vertical plate 231 is connected with a wetting motor 46, and the wetting motor 46 drives the wetting roller 44 to rotate on the second water tank 43 through a structure driven by a synchronous belt to form an active rotation mode of the wetting roller 44, so that the wetting roller 44 is kept in a state that the surface is wetted. When being stuck to the wetting roller 44 so as to be conveyed, the tape 91 can be automatically wetted to form a wet tape.

Preferably, a heatable heating plate (unshown in the figures) is fitted and fixed to a bottom surface of the second water tank 43, the heating plate may be a silicon rubber electric heating plate made of silicon rubber, and the second water tank 43 is heated by the heating plate, which can avoid the situation that the water in the second water tank 43 freezes in a cold environment.

Further refer to FIG. 18 and FIG. 19, the wetting device 4 further includes a first water tank 42 and a water containing bottle 41 which are located on the other side of the vertical plate 231. The first water tank 42 and the second water tank 43 communicate by the connection of a connecting pipe 421, so that water in the first water tank 42 is capable of circulating to the second water tank 43. Preferably, the connecting pipe 421 may be a hose. A one-way valve 411 is mounted on a bottleneck of the water containing bottle 41, and the one-way valve 411 is for one-way circulation from the inside to the outside of the water containing bottle 41. A water replenishing frame 45 is further disposed on the other side of the vertical plate 231, and the water replenishing frame 45 may be fixed to the vertical plate 231 or the portal frame 2. The water containing bottle 41 is inversed on the water replenishing frame 45, so that the water containing bottle 41 is kept in a state of being located in the first water tank 42 in a way that the bottleneck faces downwards under the limitation of the water replenishing frame 45. In this state, water in the water containing bottle 41 flows into the first water tank 42 by the one-way valve 411, and when a water level in the first water tank 42 reaches a water outlet of the one-way valve 411, the water level in the first water tank 42 can be maintained on the position of the water outlet of the one-way valve 411 under the action of an atmospheric pressure and similarly, the second water tank 43 also keeps a water level at the same height.

In addition, a plurality of pressing plates 47 are further fixed above the wetting roller 44, an arc-shaped structure sharing the same axis with the wetting roller 44 is formed above the pressing plates 47, and each of the pressing plates 47 may be connected by a first fixing rod 471 to form a fixed whole. A plurality of guide plates 48 are further disposed below a side, facing away from the tape cutting device 5, of the wetting roller 44, each of the guide plates 48 may be connected by a second fixing rod 481 to form a fixed whole, and the second fixing rod 481 and the first fixing rod 471 may be both fixed to one side of the vertical plate 231 of the lifting frame 23. During operation, the tape 91 passes through a gap between each of the pressing plates 47 and the wetting roller 44 to ensure that the pressing plates 47 can limit the tape 91 to be close to the wetting roller 44 and to avoid a situation that the tape 91 is too loose to be in contact with the wetting roller 44, so that the tape 91 is kept to be stuck to an upper surface of the wetting roller 44 so as to be conveyed, and a wetting effect of the tape 91 is guaranteed. Moreover, the tape 91 can be smoothly conveyed downwards along the guide plates 48.

In addition, in the case that no wetting motor 47 is disposed to drive the wetting roller 44, when the tape 91 is conveyed, the wetting roller 44 can also be driven to rotate by a friction force between the tape 91 and the wetting roller 44, and thus, a passive rotation mode of the wetting roller 44 is formed. Further, the wetting roller 44 may be made of a stainless steel plain roller, a stainless steel mesh roller or sponge roller, wherein in the active rotation mode of the wetting roller 44 driven by the wetting motor 47, the wetting roller 44 may be the stainless steel plain roller or the stainless steel mesh roller, and in the passive rotation mode of the wetting roller 44, the wetting roller 44 may be the sponge roller.

Figure 20:
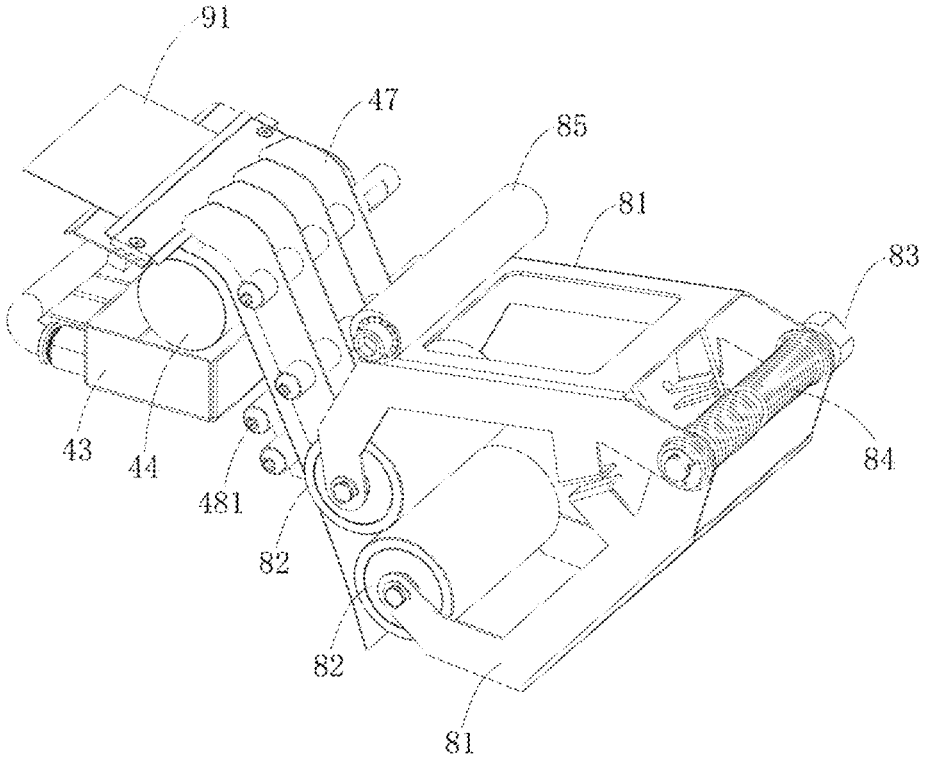
FIG. 20 is a schematic view of a three-dimensional structure for disposing a tape pressing device on one side of a second water tank.

Further refer to FIG. 20, in the present disclosure, a tape pressing device 8 is further disposed, and the tape pressing device 8 includes two torsion frames 81 pivoted with each other and guide rollers 82 disposed on ends of the two torsion frames 81. One side of the vertical plate 231 of the lifting frame 23 is connected with the two torsion frames 81, and ends, close to the second water tank 43, of the two torsion frames 81 are connected with the guide rollers 82. A third swing shaft 83 is fixed on a side, connected with the second water tank 43, of the vertical plate 231, and one end of each of the two torsion frames 81 is connected to the third swing shaft 83 to rotate, so that the two torsion frames 81 swing to each other. Further, the third swing shaft 83 is sleeved with two torsional springs 84, two ends of the torsional springs 84 respectively extend into the two torsion frames, and the two torsion frames 81 are kept in a stretching state relative to the third swing shaft 83 by means of the torsions of the torsional springs 84. In addition, the vertical plate 231 is fixedly provided with aa stop lever 85 on the torsion frame 81 located above, and the stop lever 85 stops the torsion frame 81 located above, so that the torsion frame 81 located below swings downwards under the action of torsions of the torsional springs. When the wet tape extends out of the downside of the lifting frame 23, as shown in FIG. 22, a surface, facing away from an initial end of the conveyor 1, of the wet tape is stuck to the guide rollers 82 so as to be conveyed, and thus, a wet tape 92 is guided and limited by the two guide rollers 82. In this structure, the guide roller 82 located above can play a guide role, the guide roller 82 located below can downwards press against the wet tape 92 to ensure that the wet tape 92 presses against the carton conveyed to the downside of the portal frame 2, so that the wet tape 92 can be downwards fitted to the carton.

Due to the adoption of the above-mentioned structure, after passing through the space between the upper conveying roller 71 and the lower conveying roller 72, the tape 91 pulled out of the tape roll 9 mounted on the unwinding device 3 sequentially passes through the tape through hole 501 of the tape cutting device 5, passes by the wetting roller 44 of the wetting device 4, and extends out of the downside of the lifting frame 23. During work, the tape 91 is cut off the tape cutting device 5, so that the cut tape 91 extends out of the downside of the lifting frame 23 after being wetted by the wetting roller 44. After the carton to be packaged is conveyed to the position of the portal frame 2, the bottom surface of the lifting frame 23 is kept in a state that the upside of the carton is sealed by sealing plates on two sides of the carton, after the carton moves to the position of the extended wet tape 92, the wet tape 92 is stuck to a gap between the two sealing plates, and the wet tape 92 is driven to move with the carton, so that a process of carton sealing performed by sticking the carton by using the wet tape 92 wetted after being cut off the movable blade 52 is formed.

In addition, the vertical plate 231 of the lifting frame 23 is further fixedly provided with a distance sensor 565 outside a side of the eccentric wheel 562, such as a position below the eccentric wheel 562 shown in FIG. 17, the distance sensor 565 senses the position of the eccentric pin 563, and the control system receives a signal sensed by the distance sensor 565 to control the tape cutting motor 561 to pause. Specifically, when the eccentric pin 563 rotates downwards to the downside of the eccentric wheel 562, the distance sensor 565 is triggered to send the signal to the control system, the control system controls the tape cutting motor 561 to drive the eccentric wheel 562 to rotate until the swing rod 564 drives the movable blade 52 to be away from the fixed blade 53, thereby completing the reset of the cutting device and waiting for the next cutoff instruction. In addition, it is worth mentioning that, in the present disclosure, an inductor (unshown in the figures) may be further disposed on the position of the portal frame 2 to induce the carton to be packaged and send the signal to the control system, the control system may be a PLC, and the control system controls the tape conveying motor 76, the tape cutting motor 561 and the wetting motor 46 to run after receiving the signal obtained by triggering the inductor.

Figure 21:
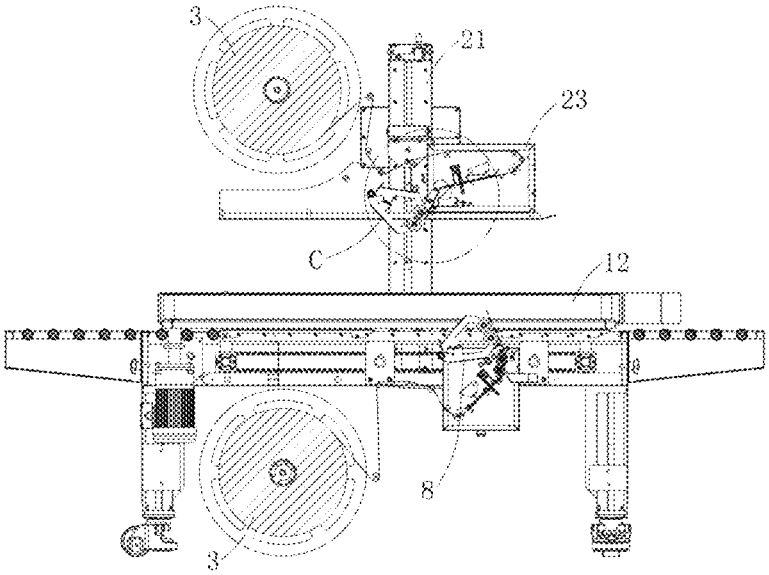
FIG. 21 is a schematic view of a lateral sectional structure of the present disclosure.
Figure 24:
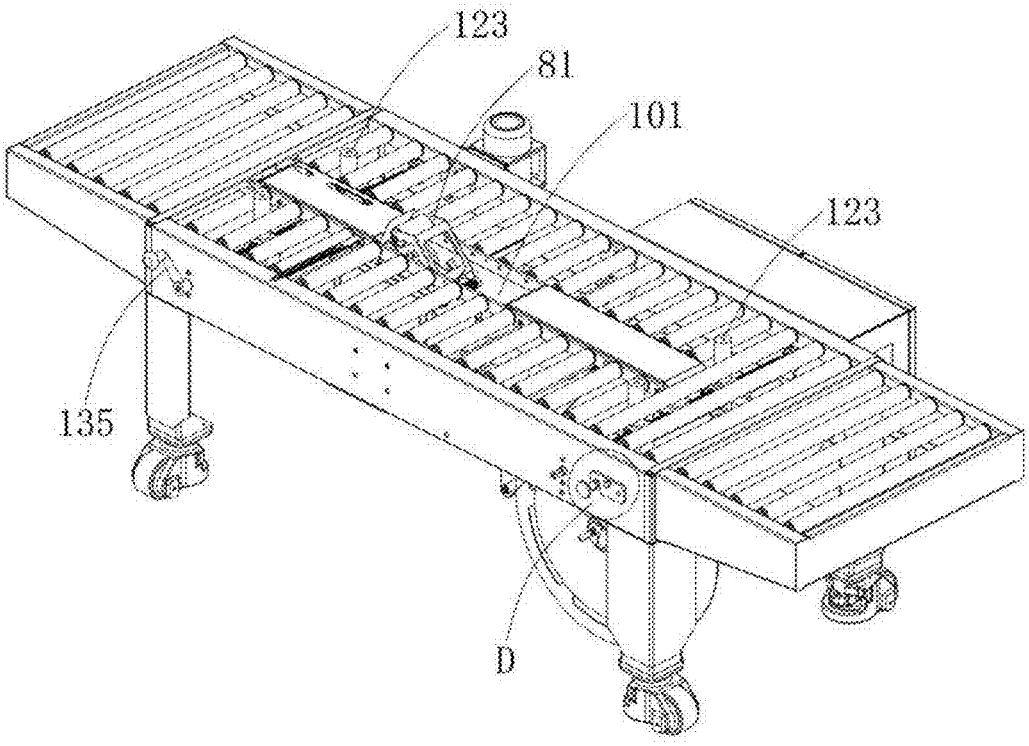
FIG. 24 is a schematic view of a three-dimensional structure for connection of all the devices below the conveyor.

In addition, as shown in FIG. 21 and FIG. 24, an avoidance gap 101 is formed on a position, corresponding to the downside of the lifting frame 23, below the conveyor 1, and the unwinding device 3, the tape conveying device 7, the tape cutting device 5, the wetting device 4 and the tape pressing device 8 are also disposed in the rack 11 of the conveyor 1. In the rack 11 of the conveyor 1, after passing through the space between the upper conveying roller 71 and the lower conveying roller 72, the tape 91 pulled out of the tape roll 9 mounted on the unwinding device 3 sequentially passes through the tape through hole 501 of the tape cutting device 5, passes by the wetting roller 44 of the wetting device 4, and upwards extends out of the avoidance gap 101, and the guide rollers 82 are upwards jacked by the torsion frames 81 above the tape pressing device 8 under the actions of the torsions of the torsional springs 84, so that the wet tape 92 can be upwards jacked by the guide rollers 82. During work, the tape 91 is cut off by the tape cutting device 5, so that the cut tape 91 extends out of the upside of the avoidance gap 101 after being wetted by the wetting roller 44. When the carton to be packaged is conveyed to the position of the portal frame 2, the surface of the conveyor 1 is kept in a state that the upside of the carton is straightly sealed by sealing plates on two sides of the bottom of the carton, after the carton moves to the position of the extended wet tape 92, the wet tape 92 is stuck to a gap between the two sealing plates, and the wet tape 92 is driven to move with the carton, so that a process of carton sealing performed by sticking the lower surface of the carton by using the wet tape 92 wetted after being cut off by the movable blade 52 is formed. In this way, the upper and lower surfaces of the carton conveyed to the position of the portal frame 2 can be packaged by the tape at the same time, great convenience is provided, and the carton scaling efficiency is favorably increased.

Figure 23:
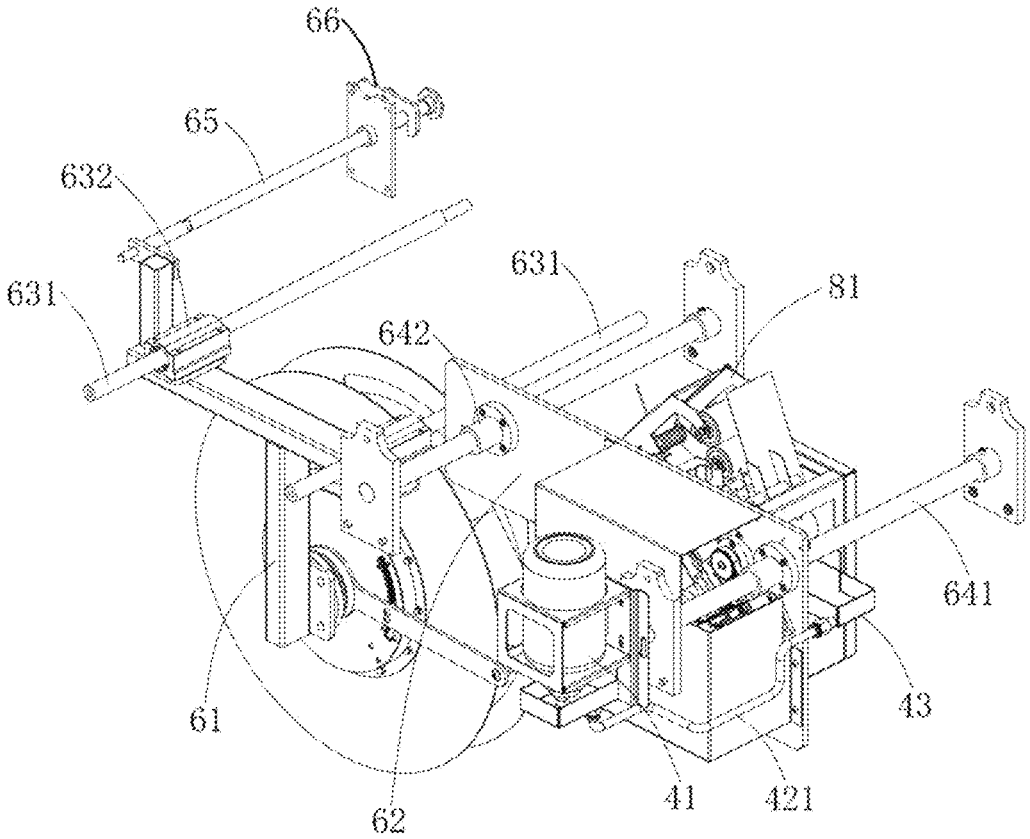
FIG. 23 is a schematic structural view of the unwinding device, the tape conveying device, the tape cutting device, the wetting device and the tape pressing device disposed inside a rack.

Further refer to FIG. 23, a first sliding frame 61 and a second sliding frame 62 are further disposed in the rack 11, and the first sliding frame 61 and the second sliding frame 62 both move relative to a side of the rack 11. The above-mentioned unwinding device 3 located in the rack 11 is connected to the first sliding frame 61, the above-mentioned tape conveying device 7, tape cutting device 5, wetting device 4 and tape pressing device 8 which are located in the rack 11 are connected to the second sliding frame 62, and the water replenishing frame 45 in the wetting device 4 located in the rack may be fixed on an outer edge of the rack 11 so as to facilitate change water in the water containing bottle 41.

Figure 25:
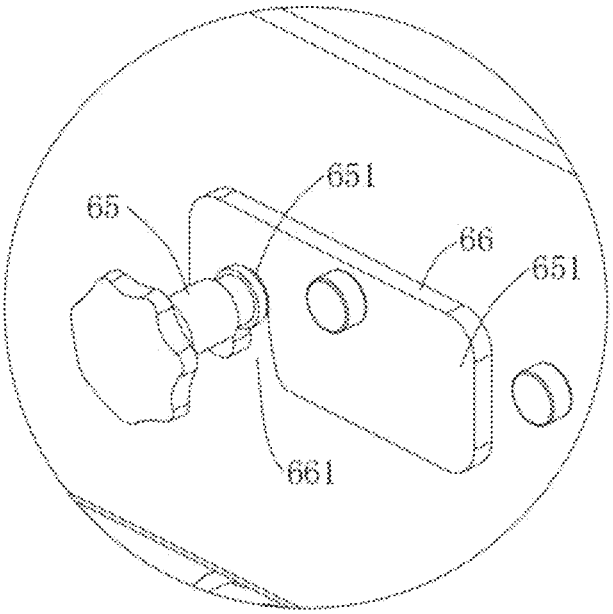
FIG. 25 is a schematic enlarged view of part D in FIG. 24.

The first sliding frame 61 is of a T-shaped structure shown in FIG. 23, and the bearing block 33 of the unwinding device 6 located in the rack 11 is fixed to the downside of the middle position of the first sliding frame 61. Second slide blocks 632 are fixed on two ends of the first sliding frame 61, two second guide rods 631 are fixed in the rack 11, and the two second guide rods 631 respectively pass through the two second slide blocks 632 so as to limit the first sliding frame 61 to be only capable of straightly sliding along two sides, opposite to the rack 11, of the second guide rods 631. A pull rod 65 is fixed on one end of the first sliding frame 61, and the pull rod 65 penetrates out of one side of the rack 11. When the first sliding frame 61 needs to be pushed or pulled, an end of the pull rod 65 is only pulled or pushed outside the rack 11, which is relatively convenient to operate. Further refer to FIG. 25, a circle of sunken annular groove 651 is disposed in a ring surface close to an end surface of an end, penetrating out of one side of the rack 11, of the pull rod 65, a rotatable clamping member 66 is connected to a side of the pull rod 65 outside the rack 11, a clamping slot 661 is disposed in the clamping member 66, when the clamping member 66 rotates until the clamping slot 661 is clamped outside the annular groove 651 of the pull rod 65, the pull rod 65 can be limited, so that the pull rod 65 is prevented from moving, and then, the first sliding frame 61 and the unwinding device 6 in the rack 11 are prevented from moving.

The second sliding frame 62 is of a flat plate structure shown in FIG. 23, guide sleeves 642 are fixed on two ends of the second sliding frame 62, two third guide rods 641 are fixed in the rack 11, and the two third guide rods 641 are respectively adapted to and pass through the two guide sleeves 642 so as to limit the second sliding frame 62 to be only capable of straightly sliding along two sides, opposite to the rack 11, of the third guide rods 641. Further refer to FIG. 24, in the tape pressing device 8 located in the rack 11, the torsion frame 81 located below is stopped by a stop lever (unshown in the figure) fixed on a side of the second sliding frame 62, so that the torsion frame 81 located above swings upwards under the action of torsions of the torsional springs 84 until passing through the avoidance gap 101; and since the torsion frame 81 passes through the avoidance gap 101, the second sliding frame 62 can be limited to be incapable of sliding relative to the second guide rods 641, and thus, the second sliding frame 62 is positioned.

Due to the adoption of the above-mentioned structure, when the tape roll 9 needs to be replaced, the torsion frame 81 upwards extending out of the avoidance gap 101 is do upwards pressed into the rack 11, and then, the second sliding frame 62 is pushed to be close to the side of the rack 11; and then, after the clamping member 66 is overturned, the pull rod 65 is pulled out to drive the first sliding frame 61 to move to be close to the side of the rack 11. Compared with a way of replacing by drilling into the rack 11, it is more convenient to replace the tape roll 9 on the side of the rack 11. After the tape roll 9 is replaced, the first sliding frame 61 is pushed into the rack 11 until the torsion frame 81 extends out of the avoidance gap 101; and then, the pull rod 65 is pushed to the inside of the rack 11 so as to drive the first sliding frame 61 to the inside of the rack 11, then, the clamping member 66 is rotated until the clamping slot 661 is clamped outside the annular groove 651 of the pull rod 65, so that the pull rod 65 is limited, and then, the first sliding frame 61 and the unwinding device 6 in the rack 11 are prevented from moving. Thus, it can be seen that the structure in the present disclosure can also facilitate replacing the tape roll 9 located below the rack 11.

The above descriptions are only specific implementations of the present disclosure, however, the design concept of the present disclosure is not limited thereto. Any non-substantive changes on the present disclosure based on this concept should fall within behaviors that violate the protection scope of the present disclosure.

What is claimed is:

1. A carton sealer adopting a wet tape, wherein the carton sealer comprises:

a conveyor, the conveyor being used for conveying a carton to be packaged;

a portal frame, the portal frame comprising upright columns and a lifting frame, the upright columns being fixed on two sides of the conveyor, the lifting frame being connected between the two upright columns, and the lifting frame lifting relative to the conveyor;

an unwinding device, the unwinding device comprising an outer shaft, the outer shaft being connected to one side of the lifting frame to rotate, and a tape roll sleeving the outer shaft so that the tape roll is fixed relative to the outer shaft;

a tape conveying device, the tape conveying device comprising an upper conveying roller, a lower conveying roller and a tape conveying motor, the upper conveying roller and the lower conveying roller being both connected to the lifting frame to rotate, and the tape conveying motor being fixed on one side of the lifting frame to drive the lower conveying roller to rotate;

a tape cutting device, the tape cutting device comprising a cutter holder and a movable blade, the cutter holder being fixed on the lifting frame, the cutter holder being provided with a tape through hole, and the movable blade moving relative to the tape through hole;

a wetting device, the wetting device comprising a water tank and a wetting roller, the water tank being fixed on the lifting frame, water being contained in the water tank, the wetting roller being connected to the water tank to rotate, and one surface of the wetting roller being immersed into the water in the water tank;

after passing through a space between the upper conveying roller and the lower conveying roller, a tape pulled out of a tape roll mounted on the unwinding device sequentially passes through the movable blade of the tape cutting device, passes by the wetting roller of the wetting device, and then extends out of the downside of the lifting frame, wherein the tape conveying device further comprises a swing frame, a first swing shaft is fixed on one side of the swing frame, and the first swing shaft passes through the lifting frame and is limited to rotate relative to the lifting frame; and the first swing shaft is fixedly provided with a swing arm on the other side of the lifting frame, and the swing arm is fixed after swinging relative to the lifting frame with the first swing shaft as an axis.

2. The carton sealer adopting a wet tape according to claim 1, wherein first slide blocks sliding vertically are disposed in the two upright columns, the portal frame is provided with a beam between the two upright columns, two ends of the beam are respectively fixed to the two first slide blocks, and the lifting frame is fixedly connected with the beam.

3. The carton sealer adopting a wet tape according to claim 2, wherein first lead screws disposed vertically are further connected in the upright columns and are limited to be only capable of rotating in the upright columns, and the first lead screws spirally pass through the first slide blocks; and chain wheels are fixed on upper ends of the first lead screws, and the chain wheels on the upper ends of the first lead screws of the two upright columns are both engaged with the same chain.

4. The carton sealer adopting a wet tape according to claim 1, wherein two sides of the conveyor are both provided with strip-shaped limiting mechanisms, the carton to be packaged is limited to move between the two limiting mechanisms, and the two limiting mechanisms synchronously move to the middle or two sides of the conveyor.

5. The carton sealer adopting a wet tape according to claim 4, wherein the conveyor is a roller conveyor, connecting columns are fixed on two ends of each of the limiting mechanisms, and second supports are fixed after the connecting columns pass through a gap between the two rollers of the conveyor; and two ends of the conveyor are both connected with second lead screws below the rollers, two ends of the second lead screws are provided with external threads opposite in direction, and the two external threads are respectively in threaded connection with the second supports on the same ends of the two limiting mechanisms.

6. The carton sealer adopting a wet tape according to claim 5, wherein the two second lead screws are both fixedly provided with second chain wheels in a rack of the conveyor, and the two second chain wheels are both engaged and connected with a second chain.

7. The carton sealer adopting a wet tape according to claim 6, wherein an end of one of the second lead screws is fixedly connected with a second handle after penetrating out of the rack of the conveyor.

8. The carton sealer adopting a wet tape according to claim 1, wherein the tape conveying device further comprises an upper pressing plate and a lower pressing plate, the lower pressing plate is fixed on the lifting frame, and the upper pressing plate rotates relative to the lower pressing plate; and each of the upper pressing plate and the lower pressing plate is provided with an avoidance gap, the lower conveying roller is located below the lower pressing plate, an upper surface of the lower conveying roller passes through the avoidance gap of the lower pressing plate, the upper conveying roller is located above the upper pressing plate, a lower surface of the upper conveying roller passes through the gap of the upper pressing plate, and a tape passes through a space between the upper pressing plate and the lower pressing plate and the space between the upper conveying roller and the lower conveying roller.

9. The carton sealer adopting a wet tape according to claim 1, wherein the carton sealer further comprises a tape pressing device, the tape pressing device comprises torsion frames and guide rollers, a second swing shaft is fixed on a side, connected with the water tank, of the lifting frame, one end of each of the two torsion frames is connected to the second swing shaft to rotate, the guide rollers are connected to ends, close to the water tank, of the two torsion frames, and a surface, facing away from an initial end of the conveyor, of the wet tape is stuck to the two guide rollers; and the second swing shaft is sleeved with torsional springs, two ends of the torsional springs respectively extend into the two torsion frames, the lifting frame is fixedly provided with a stop lever on the torsion frame located above, and the stop lever stops the torsion frame located above, so that the torsion frame located below swings downwards under the action of torsions of the torsional springs.

* * * * *